US005210013A

United States Patent [19]

Tsaur et al.

[11] Patent Number: 5,210,013

[45] Date of Patent: May 11, 1993

[54] VERY LOW COEFFICIENT OF VARIATION TABULAR GRAIN EMULSION

[75] Inventors: Allen K. Tsaur; Mamie Kam-Ng, both of Fairport, N.Y.

[73] Assignee: Eastman Kodak Company, Rochester, N.Y.

[21] Appl. No.: 699,855

[22] Filed: May 14, 1991

[51] Int. Cl.[5] ..... G03C 1/015; G03C 1/035

[52] U.S. Cl. ..... 430/567; 430/569; 430/637

[58] Field of Search ..... 430/567, 569, 637

[56] References Cited

U.S. PATENT DOCUMENTS

| | | | |
|---|---|---|---|
| 4,434,226 | 2/1984 | Wilgus et al. | 430/567 |
| 4,582,781 | 4/1986 | Chen et al. | 430/637 |
| 4,797,354 | 1/1989 | Saitou et al. | 430/567 |
| 5,043,259 | 8/1991 | Arai | 430/569 |
| 5,096,806 | 3/1992 | Nakamura et al. | 430/567 |

FOREIGN PATENT DOCUMENTS

| | | | |
|---|---|---|---|
| 362699 | 4/1990 | European Pat. Off. | 430/567 |

OTHER PUBLICATIONS

*Research Disclosure,* vol. 232, Aug., 1983, Item 23212.

*Research Disclosure,* vol. 253, May, 1985, Item 25330.

*Primary Examiner*—Charles L. Bowers, Jr.

*Assistant Examiner*—Janet C. Baxter

*Attorney, Agent, or Firm*—Carl O. Thomas

[57] ABSTRACT

A photographic emulsion is disclosed containing a coprecipitated grain population exhibiting a coefficient of variation of less than 10 percent. The coprecipitated grain population consists essentially of tabular grains which are at least 50 mole percent bromide, based on silver, and which have a mean thickness in the range of from 0.080 to 0.3 μm, and a mean tabularity of greater than 8.

43 Claims, 1 Drawing Sheet

VERY LOW COEFFICIENT OF VARIATION TABULAR GRAIN EMULSION

FIELD OF THE INVENTION

The invention relates to radiation-sensitive photographic emulsions. More specifically, the invention relates to tabular grain photographic emulsions.

BRIEF DESCRIPTION OF THE DRAWINGS

The file of this patent contains at least one drawing executed in color. Copies of this patent with color drawing(s) will be provided by the Patent and Trademark Office upon request and payment of the necessary feed.

FIG. 2 is a photomicrograph of a control tabular grain emulsion; and

FIG. 3 is a photomicrograph of a tabular grain emulsion according to the invention.

BACKGROUND

Figure 1:
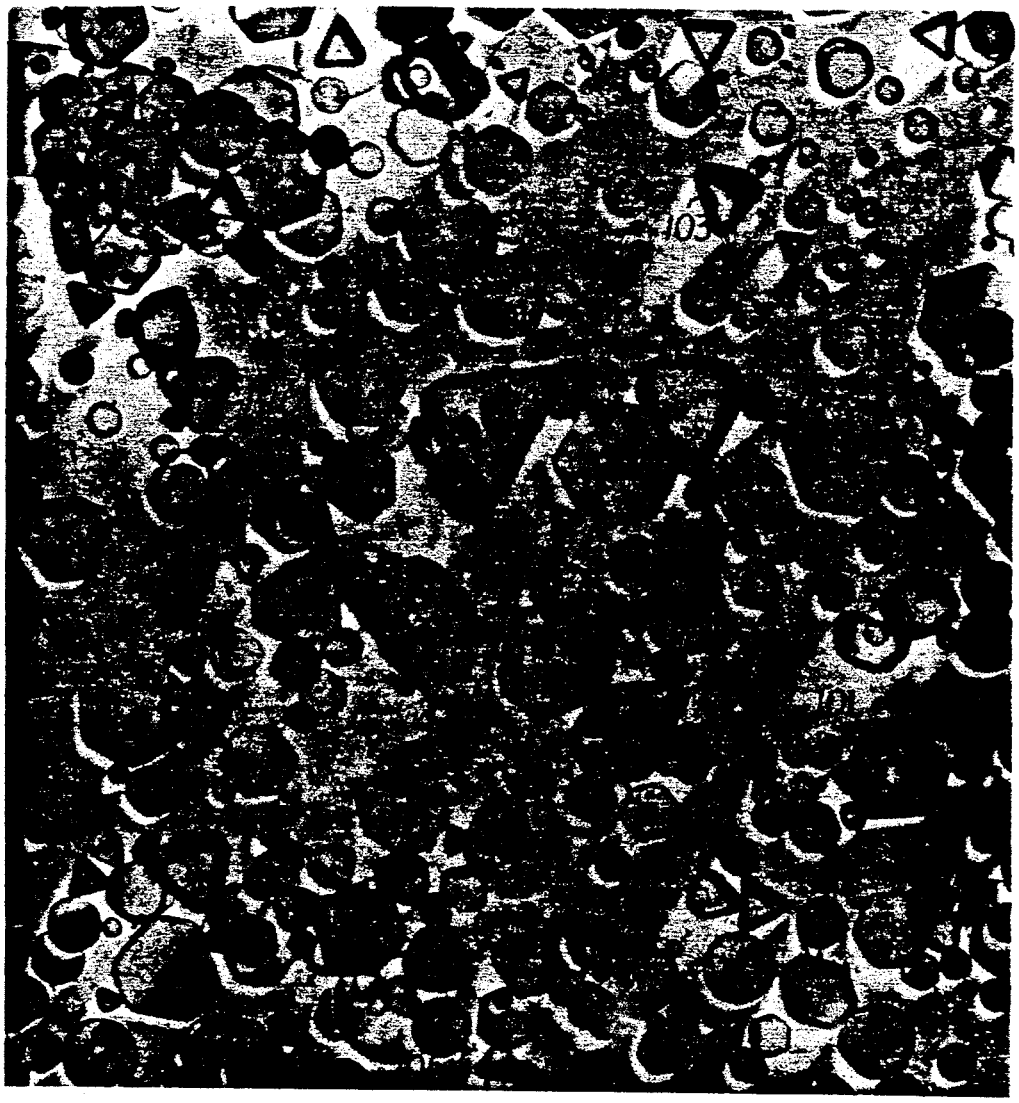
FIG. 1 (PRIOR ART)
FIG. 1 is a photomicrograph of a conventional tabular grain emulsion.

Although tabular grains had been observed in silver bromide and bromoiodide photographic emulsions dating from the earliest observations of magnified grains and grain replicas, it was not until the early 1980's that photographic advantages, such as improved speed-granularity relationships, increased covering power both on an absolute basis and as a function of binder hardening, more rapid developability, increased thermal stability, increased separation of blue and minus blue imaging speeds, and improved image sharpness in both mono- and multi-emulsion layer formats, were realized to be attainable from silver bromide and bromoiodide emulsions in which the majority of the total grain population based on grain projected area is accounted for by tabular grains satisfying the mean tabularity relationship:

$$D/t^2>25$$

where

D is the equivalent circular diameter (ECD) in μm of the tabular grains and t is the thickness in μm of the tabular grains. Once photographic advantages were demonstrated with tabular grain silver bromide and bromoiodide emulsions techniques were devised to prepare tabular grains containing silver chloride alone or in combination with other silver halides. Subsequent investigators have extended the definition of tabular grain emulsions to those in which the mean aspect ratio (D:t) of grains having parallel crystal faces is as low as 2:1. Photographic advantages attributable to the tabular grain shape can be realized with tabularities of greater than 8.

Notwithstanding the many established advantages of tabular grain emulsions, the art has observed that these emulsions tend toward more disperse grain populations than can be achieved in the preparation of regular, untwinned grain populations—e.g., cubes, octahedra and cubo-octahedral grains. This has been a concern, since reducing grain dispersity is a fundamental approach to reducing the imaging variance of the grains, and this in practical terms can be translated into more nearly uniform grain responses and higher mean grain efficiencies in imaging.

In the earliest tabular grain emulsions dispersity concerns were largely focused on the presence of significant populations of nonconforming grain shapes among the tabular grains conforming to an aim grain structure. FIG. 1 is a photomicrograph of an early high aspect ratio tabular grain silver bromoiodide emulsion first presented by Wilgus et al U.S. Pat. No. 4,434,226 to demonstrate the variety of grains that can be present in a high aspect ratio tabular grain emulsion. While it is apparent that the majority of the total grain projected area is accounted for by tabular grains, such as grain 101, nonconforming grains are also present. The grain 103 illustrates a nontabular grain. The grain 105 illustrates a fine grain. The grain 107 illustrates a nominally tabular grain of nonconforming thickness. Rods, not shown in FIG. 1, also constitute a common nonconforming grain population in tabular grain silver bromide and bromoiodide emulsions.

While the presence of nonconforming grain shapes in tabular grain emulsions has continued to detract from achieving narrow grain dispersities, as procedures for preparing tabular grains have been improved to reduce the inadvertent inclusion of nonconforming grain shapes, interest has increased in reducing the dispersity of the tabular grains. Only a casual inspection of FIG. 1 is required to realize that the tabular grains sought themselves exhibit a wide range of equivalent circular diameters.

A technique for quantifying grain dispersity that has been applied to both nontabular and tabular grain emulsions is to obtain a statistically significant sampling of the individual grain projected areas, calculate the corresponding ECD of each grain, determine the standard deviation of the grain ECDs, divide the standard deviation of the grain population by the mean ECD of the grains sampled and multiply by 100 to obtain the coefficient of variation (COV) of the grain population as a percentage. While very highly monodisperse (COV<10 percent) emulsions containing regular nontabular grains can be obtained, even the most carefully controlled precipitations of tabular grain emulsions have rarely achieved a COV of less than 20 percent. *Research Disclosure,* Vol. 232, August 1983, Item 23212 (Mignot French Patent 2,534,036, corresponding) discloses the preparation of silver bromide tabular grain emulsions with COVs ranging down to 15. *Research Disclosure* is published by Kenneth Mason Publications, Ltd., Dudley Annex, 21a North Street, Emsworth, Hampshire P010 7DQ, England.

Saitou et al U.S. Pat. No. 4,797,354 reports in Example 9 a COV of 11.1 percent; however, this number is not comparable to that reported by Mignot. Saitou et al is reporting only the COV within a selected tabular grain population. Excluded from these COV calculations is the nonconforming grain population within the emulsion, which, of course, is the grain population that has the maximum impact on increasing grain dispersity and overall COV. When the total grain populations of the Saitou et al emulsions are sampled, significantly increased COVs result.

Techniques for quantitatively evaluating emulsion grain dispersity originally developed for nontabular grain emulsions and later applied to tabular grain emulsions provide a measure of the dispersity of ECDs. Given the essentially isometric shapes of most nontabular grains, dispersity measurements based on ECDs were determinative. As first the nonconforming grain populations and then the diameter dispersity of the tabular grains themselves have been restricted in tabular grain emulsions, those skilled in the art have begun to address now a third variance parameter of tabular grain emulsions which, unlike the first two, is not addressed by COV measurements. The importance of controlling variances in the thicknesses of tabular grains has been gradually realized. It is theoretically possible, for example, to have two tabular grain emulsions with the same measured COV that nevertheless differ significantly in grain to grain variances, since COVs are based exclusively on the ECDs of the tabular grains and do not take variances in grain thicknesses into account.

Referring again to FIG. 1, it is apparent that grain thicknesses can be calculated from observed grain replica shadow lengths. Shadow lengths provide the most common approach to measuring tabular grain thicknesses for purposes of calculating tabularity ($D/t^2$, as defined above) or aspect ratio (D/t). It is, however, not possible to measure variances in tabular grain thicknesses with the precision that ECD variances are measured, since the thicknesses of tabular grains are small in relation to their diameters and shadow length determinations are less precise than diameter measurements.

Although not developed to the level of a quantitative statistical measurement technique, those precipitating tabular grain emulsions have observed that the thickness dispersity of tabular grain emulsions can be visually observed and qualitatively compared as a function of their differing grain reflectances. When white light is directed toward a tabular grain population observed through a microscope, the light reflected from each tabular grain is reflected from its upper and lower major crystal faces. By traveling a slightly greater distance (twice the thickness of a tabular grain) light reflected from a bottom major crystal surface is phase shifted with respect to that reflected from a top major crystal surface. Phase shifting reduces the observed reflection of differing wavelengths to differing degrees, resulting in tabular grains of differing wavelengths exhibiting differing hues. An illustration of this effect is provided in *Research Disclosure,* Vol. 253, May, 1985, Item 25330. In the tabular grain thickness range of from about 0.08 to 0.30 μm distinct differences in hue of reflected light are often visually detectable with thickness differences of 0.01 μm or less. The same differences in hue can be observed when overlapping grains have a combined thickness in the indicated range. A specific illustration of hue differences is provided in FIG. 2. Tabular grain emulsions with low tabular grain thickness dispersities can be qualitatively distinguished by the proportions of tabular grains with visually similar hues. A specific illustration is provided in FIG. 3, which is an emulsion prepared in accordance with the invention discussed in the examples below. Rigorous quantitative determinations of tabular grain thickness dispersities determined from reflected hues have not yet been reported.

CROSS-REFERENCED FILINGS

The following concurrently filed, commonly assigned patent applications are cross-referenced:

Tsaur and Kam-Ng U.S. Ser. No. 700,220, titled PROCESS OF PREPARING A REDUCED DISPERSITY TABULAR GRAIN EMULSION, now U.S. Pat. No. 5,147,771, discloses a process for the preparation of tabular grain emulsions of reduced dispersity that employs an alkylene oxide block copolymer surfactant that contains two terminal lipophilic block units joined by a central hydrophilic block unit.

Tsaur and Kam-Ng U.S. Ser. No. 700,019, titled PROCESS OF PREPARING A REDUCED DISPERSITY TABULAR GRAIN EMULSION, now allowed, discloses a process for the preparation of tabular grain emulsions of reduced dispersity that employs an alkylene oxide block copolymer surfactant that contains two terminal hydrophilic block units joined by a central lipophilic block unit.

Tsaur and Kam-Ng U.S. Ser. No. 699,851 titled PROCESS OF PREPARING A REDUCED DISPERSITY TABULAR GRAIN EMULSION, now U.S. Pat. No. 5,147,773, discloses a process for the preparation of tabular grain emulsions of reduced dispersity that employs an alkylene oxide block copolymer surfactant that contains at least three terminal hydrophilic block units joined by a central lipophilic block linking unit.

Tsaur and Kam-Ng U.S. Ser. No. 700,020, titled PROCESS OF PREPARING A REDUCED DISPERSITY TABULAR GRAIN EMULSION, now U.S. Pat. No. 5,147,772 discloses a process for the preparation of tabular grain emulsions of reduced dispersity that employs an alkylene oxide block copolymer surfactant that contains at least three terminal lipophilic block units joined by a central hydrophilic block linking unit.

Loblaw, Tsaur and Kam-Ng U.S. Ser. No. 700,228, titled IMPROVED PHOTOTYPESETTING PAPER, now abandoned in favor of U.S. Ser. No. 849,928, filed Mar. 12, 1992, discloses a phototypesetting paper containing a tabular grain emulsion having a coefficient of variation of less than 15 percent.

Dickerson and Tsaur U.S. Ser. No. 699,840, titled RADIOGRAPHIC ELEMENTS WITH IMPROVED DETECTIVE QUANTUM EFFICIENCIES now abandoned in favor of U.S. Ser. No. 849,917, filed Mar. 12, 1992, discloses a dual coated radiographic element containing a tabular grain emulsion having a coefficient of variation of less than 15 percent.

Jagannathan, Mehta, Tsaur and Kam-Ng U.S. Ser. No 700,227, titled HIGH EDGE CUBICITY TABULAR GRAIN EMULSIONS, now abandoned in favor of U.S. Ser. No. 848,626, which is now also abandoned, discloses tabular grain emulsions in which an increased percentage of the edge surfaces of the tabular grains lie in non-{111} crystallographic planes.

SUMMARY OF THE INVENTION

In attempting to achieve a minimal level of grain dispersity in a tabular grain emulsion there is a hierarchy of objectives:

The first objective is to eliminate or reduce to negligible levels nonconforming grain populations from the tabular grain emulsion during grain precipitation process. The presence of one or more nonconforming grain populations (usually nontabular grains) within an emulsion containing predominantly tabular grains is a primary concern in seeking emulsions of minimal grain dispersity. Nonconforming grain populations in tabular grain emulsions typically exhibit lower projected areas and greater thicknesses than the tabular grains. Nontabular grains interact differently with light on exposure than tabular grains. Whereas the majority of tabular grain surface areas are oriented parallel to the coating plane, nontabular grains exhibit near random crystal facet orientations. The ratio of surface area to grain volume is much higher for tabular grains than for nontabular grains. Finally, lacking parallel twin planes, nontabular grains differ internally from the conforming tabular grains. All of these differences of nontabular grains apply also to nonconforming thick (singly twinned) tabular grains as well.

The second objective is to minimize the ECD variance among conforming tabular grains. Once the nonconforming grain population of a tabular grain emulsion has been well controlled, the next level of concern is the diameter variances among the tabular grains. The probability of photon capture by a particular grain on exposure of an emulsion is a function of its ECD. Spectrally sensitized tabular grains with the same ECDs have the same photon capture capability.

The third objective is to minimize variances in the thicknesses of the tabular grains within the conforming tabular grain population. Achievement of the first two objectives in dispersity control can be measured in terms of COV, which provides a workable criterion for distinguishing emulsions on the basis of grain dispersity. As between tabular grain emulsions of similar COVs further ranking of dispersity can be based on assessments of grain thickness dispersity. At present, this cannot be achieved with the same quantitative precision as in calculating COVs, but it is nevertheless an important basis for distinguishing tabular grain populations. A tabular grain with an ECD of 1.0 μm and a thickness of 0.01 μm contains only half the silver of a tabular grain with the same ECD and a thickness of 0.02 μm. The photon capture capability in the spectral region of native sensitivity of the second grain is twice that of the first, since photon capture within the grain is a function of grain volume. Further, the light reflectances of the two grains are quite dissimilar.

In one aspect, this invention is directed to a photographic emulsion containing a coprecipitated grain population exhibiting a coefficient of variation of less than 10 percent, based on the total grains of the population, the grain population containing at least 50 mole percent bromide, based on silver, and consisting essentially of tabular grains having a mean thickness in the range of from 0.080 to 0.3 μm and a mean tabularity of greater than 8.

DESCRIPTION OF PREFERRED EMBODIMENTS

This invention is directed to tabular grain photographic emulsions having coefficients of variation lower than heretofore have been achieved in the art. Specifically, the invention is directed to tabular grain photographic emulsions which contain a coprecipitated grain population that consists essentially of tabular grains. The coprecipitated grain population exhibits a coefficient of variation, based on the entire coprecipitated grain population, of less than 10 percent.

As employed herein the term "minimum COV" is employed to indicate an emulsion having a COV of less than 10 percent, based on the entire population of grains formed in the same precipitation (i.e., the entire coprecipitated grain population). The term "coprecipitated grain population" is used to exclude grains that are added to an emulsion after a tabular grain population has been formed. Additional grain populations are sometimes introduced into an emulsion by blending after precipitation or by intentional belated grain formation, commonly referred to as renucleation.

In addition to exhibiting minimum COVs the emulsions of this invention also exhibit low grain-to-grain variations in the thicknesses of the coprecipitated tabular grain population. This has been observed by the low chromatic variances of light reflections from the tabular grain population. Tabular grain emulsions according to this invention have been prepared in which the majority of the tabular grains are of one hue or closely related family of hues. Tabular grain emulsions satisfying the requirements of this invention have been prepared in which the majority of the tabular grains are either white, yellow, buff, brown, purple, blue, cyan, green, orange, magenta or red. From these observations it has been determined that the minimum COV emulsions of this invention can be prepared with greater than 50 percent, preferably greater than 70 percent and optimally greater than 90 percent of the total tabular grain projected area exhibiting a hue indicative of thickness variations within ±0.01 μm of the mean tabular grain thickness.

The emulsions of this invention have been realized by the discovery and optimization of novel processes for the precipitation of tabular grain emulsions of reduced grain dispersities.

It has been found possible to prepare a coprecipitated grain population consisting essentially of tabular grains and exhibiting a minimum COV over a range of grain dimensions and halide compositions. The minimum COV coprecipitated grain populations of the emulsions of this invention contain at least 50 mole percent bromide, based on silver, and consist essentially of tabular grains having a mean thickness in the range of from 0.080 to 0.3 μm and a mean tabularity of greater than 8.

The coprecipitated grain population can consist essentially of silver bromide as the sole silver halide. Silver bromide is incorporated in the grains during both grain nucleation and growth. Silver iodide and/or silver chloride can also be present in the grains, exhibiting a combined concentration of up to 50 mole percent, based on total silver. Although the processes of preparation employed have placed restrictions, discussed below, on chloride and iodide ion concentrations during grain nucleation, such small amounts of silver halide are required to achieve nucleation, that notwithstanding the absence of chloride and/or iodide ions during nucleation grains can be formed having no detectable chloride and/or iodide ion nonuniformities. It is, of course, possible to modify halide ion concentrations during grain growth so that detectable nonuniformities in halide ion distributions are observable. In their preferred form the tabular grains at a central location extending between their major faces contain at least 90 mole percent bromide, optimally at least 94 mole percent bromide, based on total silver. Halide content at a central location extending between the major faces of the tabular grains can be determined as taught by Solberg et al U.S. Pat. No. 4,433,048, for example, the disclosure of which is here incorporated by reference. Except for the requirement of at least 50 mole percent bromide in the fully formed coprecipitated grain population, the halide distribution within the coprecipitated grain population can follow any convenient conventional profile.

Preparation investigations have centered on achieving tabular grains of the dimensional ranges most commonly employed in the photographic emulsions. Coprecipitated grain populations consisting essentially of tabular grains having mean thicknesses in the range of from 0.080 to 0.3 μm and mean tabularities (as defined above) of greater than 8 are well within the capabilities of the precipitation procedures set forth below. These ranges permit any mean tabular grain ECD to be selected appropriate for the photographic application. In other words, the present invention is compatible with the full range of mean ECDs of conventional tabular grain emulsions. A mean ECD of about 10 μm is typically regarded as the upper limit for photographic utility. For most applications the tabular grains exhibit a mean ECD of 5 μm or less. Since increased ECDs contribute to achieving higher mean aspect ratios and tabularities, it is generally preferred that mean ECDs of the tabular grains be at least about 0.4 μm.

Any mean tabular grain aspect ratio within the mean tabular grain thickness and tabularity ranges indicated is contemplated. Mean tabular grain aspect ratios for the tabular grains of the coprecipitated grain population can range from 2 to 100 or more. This range of mean aspect ratios includes low (<5), intermediate (5 to 8), and high (>8) mean aspect ratio tabular grain emulsions. For the majority of photographic applications mean tabular grain aspect ratios in the range of from about 10 to 60 are preferred.

While mean aspect ratios have been most extensively used in the art to characterize dimensionally tabular grain emulsions, mean tabularities ($D/t^2$, as defined) provide an even better quantitative measure of the qualities that set tabular grain populations apart from non-tabular grain populations. The emulsions of the invention contain coprecipitated tabular grain populations exhibiting tabularities of greater than 8, preferably greater than 25. Typically mean tabularities of the coprecipitated tabular grain populations of the emulsions of this invention range up to about 500. Since tabularities are increased exponentially with decreased tabular grain mean thicknesses, extremely high tabularities can be realized ranging up to 1000 or more.

The minimum COV emulsions of this invention have been made possible by the discovery and optimization of improved processes for the preparation of tabular grain emulsions by (a) first forming a population of grain nuclei, (b) ripening out a portion of the grain nuclei in the presence of a ripening agent, and (c) undertaking post-ripening grain growth. Minimum COV coprecipitated grain population emulsions consisting essentially of tabular grains satisfying the requirements of this invention has resulted from the discovery of specific techniques for forming the population of grain nuclei.

To achieve the lowest possible grain dispersities the first step is undertake formation of the silver halide grain nuclei under conditions that promote uniformity. Prior to forming the grain nuclei bromide ion is added to the dispersing medium. Although other halides can be added to the dispersing medium along with silver, prior to introducing silver, halide ions in the dispersing medium consist essentially of bromide ions.

The balanced double jet precipitation of grain nuclei is specifically contemplated in which an aqueous silver salt solution and an aqueous bromide salt are concurrently introduced into a dispersing medium containing water and a hydrophilic colloid peptizer. One or both of chloride and iodide salts can be introduced through the bromide jet or as a separate aqueous solution through a separate jet. It is preferred to limit the concentration of chloride and/or iodide to about 20 mole percent, based on silver, most preferably these other halides are present in concentrations of less than 10 mole percent (optimally less than 6 mole percent) based on silver. Silver nitrate is the most commonly utilized silver salt while the halide salts most commonly employed are ammonium halides and alkali metal (e.g., lithium, sodium or potassium) halides. The ammonium counter ion does not function as a ripening agent since the dispersing medium is at an acid pH—i.e., less than 7.0.

Instead of introducing aqueous silver and halide salts through separate jets a uniform nucleation can be achieved by introducing a Lippmann emulsion into the dispersing medium. Since the Lippmann emulsion grains typically have a mean ECD of less than 0.05 μm, a small fraction of the Lippmann grains initially introduced serve as deposition sites while all of the remaining Lippmann grains dissociate into silver and halide ions that precipitate onto grain nuclei surfaces. Techniques for using small, preformed silver halide grains as a feedstock for emulsion precipitation are illustrated by Mignot U.S. Pat. No. 4,334,012; Saito U.S. Pat. No. 4,301,241; and Solberg et al U.S. Pat. No. 4,433,048.

Minimum COV emulsions satisfying the requirements of this invention can be prepared by producing prior to ripening a population of parallel twin plane containing grain nuclei in the presence of selected surfactants. Specifically, it has been discovered that the dispersity of the tabular grain emulsions of this invention can be reduced by introducing parallel twin planes in the grain nuclei in the presence of one or a combination of polyalkylene oxide block copolymer surfactants. Polyalkylene oxide block copolymer surfactants generally and those contemplated for use in preparing the emulsions of this invention in particular are well known and have been widely used for a variety of purposes. They are generally recognized to constitute a major category of nonionic surfactants. For a molecule to function as a surfactant it must contain at least one hydrophilic unit and at least one lipophilic unit linked together. A general review of block copolymer surfactants is provided by I. R. Schmolka, "A Review of Block Polymer Surfactants", J. Am. Oil Chem. Soc., Vol. 54, No. 3, 1977, pp. 110–116, and A. S. Davidsohn and B. Milwidsky, *Synthetic Detergents*, John Wiley & Sons, N.Y. 1987, pp. 29–40, and particularly pp. 34–36, the disclosures of which are here incorporated by reference.

One category of polyalkylene oxide block copolymer surfactant found to be useful in the preparation of the emulsions of this invention is comprised of two terminal lipophilic alkylene oxide block units linked by a hydrophilic alkylene oxide block unit accounting for at least 4 percent of the molecular weight of the copolymer. These surfactants are hereinafter referred to category S-I surfactants.

The category S-I surfactants contain at least two terminal lipophilic alkylene oxide block units linked by a hydrophilic alkylene oxide block unit and can be, in a simple form, schematically represented as indicated by diagram I below:

| | | |
|---|---|---|
| LAO1 | HAO1 | LAO1 |

(I)

where

LAO1 in each occurrence represents a terminal lipophilic alkylene oxide block unit and HAO1 represents a hydrophilic alkylene oxide block linking unit.

It is generally preferred that HAO1 be chosen so that the hydrophilic block linking unit constitutes from 4 to 96 percent of the block copolymer on a total weight basis.

It is, of course, recognized that the block diagram I above is only one example of a polyalkylene oxide block copolymer having at least two terminal lipophilic block units linked by a hydrophilic block unit. In a common variant structure interposing a trivalent amine linking group in the polyalkylene oxide chain at one or both of the interfaces of the LAO1 and HAO1 block units can result in three or four terminal lipophilic groups.

In their simplest possible form the category S-I polyalkylene oxide block copolymer surfactants are formed by first condensing ethylene glycol and ethylene oxide to form an oligomeric or polymeric block repeating unit that serves as the hydrophilic block unit and then completing the reaction using 1,2-propylene oxide. The propylene oxide adds to each end of the ethylene oxide block unit. At least six 1,2-propylene oxide repeating units are required to produce a lipophilic block repeating unit. The resulting polyalkylene oxide block copolymer surfactant can be represented by formula II:

$$HO-(\overset{CH_3}{\overset{|}{C}}HCH_2O)_x-(CH_2CH_2O)_y-(CH_2\overset{CH_3}{\overset{|}{C}}HO)_{x'}-H \quad (II)$$

where x and x' are each at least 6 and can range up to 120 or more and y is chosen so that the ethylene oxide block unit maintains the necessary balance of lipophilic and hydrophilic qualities necessary to retain surfactant activity. It is generally preferred that y be chosen so that the hydrophilic block unit constitutes from 4 to 96 percent by weight of the total block copolymer. Within the above ranges for x and x', y can range from 2 to 300 or more.

Generally any category S-I surfactant block copolymer that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general surfactants having molecular weights of at least 760 (preferably at least 1,000) to less than about 16,000 (preferably less than about 10,000) are contemplated for use.

In a second category, hereinafter referred to as category S-II surfactants, the polyalkylene oxide block copolymer surfactants contain two terminal hydrophilic alkylene oxide block units linked by a lipophilic alkylene oxide block unit and can be, in a simple form, schematically represented as indicated by diagram III below:

| | | |
|---|---|---|
| HAO2 | LAO2 | HAO2 |

(III)

where

HAO2 in each occurrence represents a terminal hydrophilic alkylene oxide block unit and LAO2 represents a lipophilic alkylene oxide block linking unit. It is generally preferred that LAO2 be chosen so that the lipophilic block unit constitutes from 4 to 96 percent of the block copolymer on a total weight basis.

It is, of course, recognized that the block diagram III above is only one example of a category S-II polyalkylene oxide block copolymer having at least two terminal hydrophilic block units linked by a lipophilic block unit. In a common variant structure interposing a trivalent amine linking group in the polyakylene oxide chain at one or both of the interfaces of the LAO2 and HAO2 block units can result in three or four terminal hydrophilic groups.

In their simplest possible form the category S-II polyalkylene oxide block copolymer surfactants are formed by first condensing 1,2-propylene glycol and 1,2-propylene oxide to form an oligomeric or polymeric block repeating unit that serves as the lipophilic block linking unit and then completing the reaction using ethylene oxide. Ethylene oxide is added to each end of the 1,2-propylene oxide block unit. At least thirteen (13) 1,2-propylene oxide repeating units are required to produce a lipophilic block repeating unit. The resulting polyalkylene oxide block copolymer surfactant can be represented by formula IV:

$$HO-(CH_2CH_2O)_y-(\overset{CH_3}{\overset{|}{C}}HCH_2O)_x-(CH_2CH_2O)_{y'}-H \quad (IV)$$

where x is at least 13 and can range up to 490 or more and y and y' are chosen so that the ethylene oxide block units maintain the necessary balance of lipophilic and hydrophilic qualities necessary to retain surfactant activity. It is generally preferred that x be chosen so that the lipophilic block unit constitutes from 4 to 96 percent by weight of the total block copolymer; thus, within the above range for x, y and y' can range from 1 to 320 or more.

Any category S-II block copolymer surfactant that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general surfactants having molecular weights of at least 1,000 up to less than about 30,000 (preferably less than about 20,000) are contemplated for use.

In a third category, hereinafter referred to as category S-III surfactants, the polyalkylene oxide surfactants contain at least three terminal hydrophilic alkylene oxide block units linked through a lipophilic alkylene oxide block linking unit and can be, in a simple form, schematically represented as indicated by formula V below:

$$(H-HAO3)_z-LOL-(HAO3-H)_{z'} \quad (V)$$

where

HAO3 in each occurrence represents a terminal hydrophilic alkylene oxide block unit, LOL represents a lipophilic alkylene oxide block linking unit, z is 2 and z' is 1 or 2.

The polyalkylene oxide block copolymer surfactants employed in the practice of the invention can take the form shown in formula VI:

$$(H-HAO3-LAO3)_z-L-(LAO3-HAO3-H)_{z'} \quad (VI)$$

where

HAO3 in each occurrence represents a terminal hydrophilic alkylene oxide block unit, LAO3 in each occurrence represents a lipophilic alkylene oxide block unit, L represents a linking group, such as amine or diamine, z is 2 and z' is 1 or 2.

The linking group L can take any convenient form. It is generally preferred to choose a linking group that is itself lipophilic. When z+z' equal three, the linking group must be trivalent. Amines can be used as trivalent linking groups. When an amine is used to form the linking unit L, the polyalkylene oxide block copolymer surfactants employed in the practice of the invention can take the form shown in formula VII:

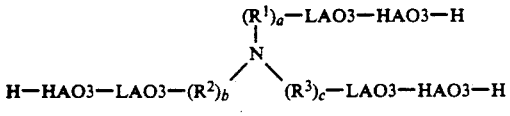

(VII)

where

HAO3 and LAO3 are as previously defined;

$R^1$, $R^2$ and $R^3$ are independently selected hydrocarbon linking groups, preferably phenylene groups or alkylene groups containing from 1 to 10 carbon atoms; and a, b and c are independently zero or 1. To avoid steric hindrances it is generally preferred that at least one (optimally at least two) of a, b and c be 1. An amine (preferably a secondary or tertiary amine) having hydroxy functional groups for entering into an oxyalkylation reaction is a contemplated starting material for forming a polyalkylene oxide block copolymer satisfying formula VII.

When z+z' equal four, the linking group must be tetravalent. Diamines are preferred tetravalent linking groups. When a diamine is used to form the linking unit L, the polyalkylene oxide block copolymer surfactants employed in the practice of the invention can take the form shown in formula VIII:

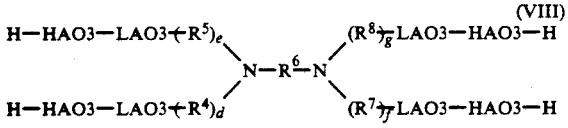

(VIII)

where

HAO3 and LAO3 are as previously defined;

$R^4$, $R^5$, $R^6$, $R^7$ and $R^8$ are independently selected hydrocarbon linking groups, preferably phenylene groups or alkylene groups containing from 1 to 10 carbon atoms; and d, e, f and g are independently zero or 1. It is generally preferred that LAO3 be chosen so that the LOL lipophilic block unit accounts for from 4 to less than 96 percent, preferably from 15 to 95 percent, optimally 20 to 90 percent, of the molecular weight of the copolymer.

In a fourth category, hereinafter referred to as category S-IV surfactants, the polyalkylene oxide block copolymer surfactants employed in the practice of this invention contain at least three terminal lipophilic alkylene oxide block units linked through a hydrophilic alkylene oxide block linking unit and can be, in a simple form, schematically represented as indicated by formula IX below:

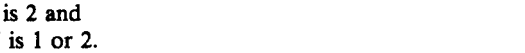

(IX)

where

LAO4 in each occurrence represents a terminal lipophilic alkylene oxide block unit, HOL represents a hydrophilic alkylene oxide block linking unit, z is 2 and z' is 1 or 2.

The polyalkylene oxide block copolymer surfactants employed in the practice of the invention can take the form shown in formula X:

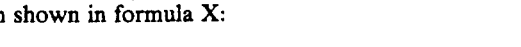

(X)

where

HAO4 in each occurrence represents a hydrophilic alkylene oxide block unit,

LAO4 in each occurrence represents a terminal lipophilic alkylene oxide block unit, L'represents a linking group, such as amine or diamine, z is 2 and z' is 1 or 2.

The linking group L' can take any convenient form. It is generally preferred to choose a linking group that is itself hydrophilic. When z+z' equal three, the linking group must be trivalent. Amines can be used as trivalent linking groups When an amine is used to form the linking unit L', the polyalkylene oxide block copolymer surfactants employed in the practice of the invention can take the form shown in formula XI:

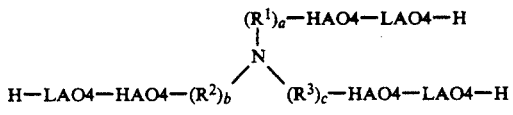

(XI)

where

HAO4 and LAO4 are as previously defined;

$R^1$, $R^2$ and $R^3$ are independently selected hydrocarbon linking groups, preferably phenylene groups or alkylene groups containing from 1 to 10 carbon atoms; and a, b and c are independently zero or 1. To avoid steric hindrances it is generally preferred that at least one (optimally at least two) of a, b and c be 1. An amine (preferably a secondary or tertiary amine) having hydroxy functional groups for entering into an oxyalkylation reaction is a contemplated starting material for forming a polyalkylene oxide block copolymer satisfying formula XI.

When z+z' equal four, the linking group must be tetravalent. Diamines are preferred tetravalent linking groups. When a diamine is used to form the linking unit L', the polyalkylene oxide block copolymer surfactants employed in the practice of the invention can take the form shown in formula XII:

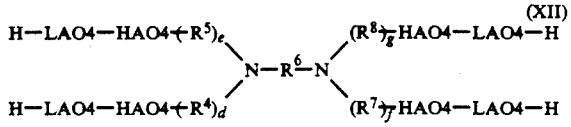

(XII)

where

HAO4 and LAO4 are as previously defined;

$R^4$, $R^5$, $R^6$, $R^7$ and $R^8$ are independently selected hydrocarbon linking groups, preferably phenylene groups or alkylene groups containing from 1 to 10 carbon atoms; and d, e, f and g are independently zero or 1. It is generally preferred that LAO4 be chosen so that the HOL hydrophilic block unit accounts for from 4 to 96 percent, preferably from 5 to 85 percent, of the molecular weight of the copolymer.

In their simplest possible form the polyalkylene oxide block copolymer surfactants of categories S-III and S-IV employ ethylene oxide repeating units to form the hydrophilic (HAO3 and HAO4) block units and 1,2-propylene oxide repeating units to form the lipophilic (LAO3 and LAO4) block units. At least three propylene oxide repeating units are required to produce a lipophilic block repeating unit. When so formed, each H-HAO3-LAO3- or H-LAO4-HAO4- group satisfies formula XIIIa or XIIIb, respectively:

$$H-(OCH_2CH_2)_y-(O\overset{\overset{CH_3}{|}}{C}HCH_2)_x- \quad \text{(XIIIa)}$$

$$H-(O\overset{\overset{CH_3}{|}}{C}HCH_2)_x-(OCH_2CH_2)_y- \quad \text{(XIIIb)}$$

where x is at least 3 and can range up to 250 or more and y is chosen so that the ethylene oxide block unit maintains the necessary balance of lipophilic and hydrophilic qualities necessary to retain surfactant activity. This allows y to be chosen so that the hydrophilic block units together constitute from greater than 4 to 96 percent (optimally 10 to 80 percent) by weight of the total block copolymer. In this instance the lipophilic alkylene oxide block linking unit, which includes the 1,2-propylene oxide repeating units and the linking moieties, constitutes from 4 to 96 percent (optimally 20 to 90 percent) of the total weight of the block copolymer. Within the above ranges, y can range from 1 (preferably 2) to 340 or more.

The overall molecular weight of the polyalkylene oxide block copolymer surfactants of categories S-III and S-IV have a molecular weight of greater than 1100, preferably at least 2,000. Generally any such block copolymer that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general category S-III surfactants having molecular weights of less than about 60,000, preferably less than about 40,000, are contemplated for use, category S-IV surfactants having molecular weight of less than 50,000, preferably less than about 30,000, are contemplated for use.

While commercial surfactant manufacturers have in the overwhelming majority of products selected 1,2-propylene oxide and ethylene oxide repeating units for forming lipophilic and hydrophilic block units of nonionic block copolymer surfactants on a cost basis, it is recognized that other alkylene oxide repeating units can, if desired, be substituted in any of the category S-I, S-II, S-III and S-IV surfactants, provided the intended lipophilic and hydrophilic properties are retained. For example, the propylene oxide repeating unit is only one of a family of repeating units that can be illustrated by formula XIV $$-(O\overset{\overset{R^9}{|}}{C}HCH_2)- \quad \text{(XIV)}$$

where $R^9$ is a lipophilic group, such as a hydrocarbon—e.g., alkyl of from 1 to 10 carbon atoms or aryl of from 6 to 10 carbon atoms, such as phenyl or naphthyl.

In the same manner, the ethylene oxide repeating unit is only one of a family of repeating units that can be illustrated by formula XV:

$$-(O\overset{\overset{R^{10}}{|}}{C}HCH_2)- \quad \text{(XV)}$$

where $R^{10}$ is hydrogen or a hydrophilic group, such as a hydrocarbon group of the type forming $R^9$ above additionally having one or more polar substituents—e.g., one, two, three or more hydroxy and/or carboxy groups.

In each of the surfactant categories each of block units contain a single alkylene oxide repeating unit selected to impart the desired hydrophilic or lipophilic quality to the block unit in which it is contained. Hydrophilic-lipophilic balances (HLB's) of commercially available surfactants are generally available and can be consulted in selecting suitable surfactants.

Only very low levels of surfactant are required in the emulsion at the time parallel twin planes are being introduced in the grain nuclei to reduce the grain dispersity of the emulsion being formed. Surfactant weight concentrations are contemplated as low as 0.1 percent, based on the interim weight of silver—that is, the weight of silver present in the emulsion while twin planes are being introduced in the grain nuclei. A preferred minimum surfactant concentration is 1 percent, based on the interim weight of silver. A broad range of surfactant concentrations have been observed to be effective. No further advantage has been realized for increasing surfactant weight concentrations above 100 percent of the interim weight of silver using category S-I surfactants or above 50 percent of the interim weight of silver using category S-II, S-III or S-IV surfactants. However, surfactant concentrations of 200 percent of the interim weight of silver or more are considered feasible using category S-I surfactants or 100 percent or more using category S-II, S-III or S-IV surfactants.

The invention is compatible with either of the two most common techniques for introducing parallel twin planes into grain nuclei. The preferred and most common of these techniques is to form the grain nuclei population that will be ultimately grown into tabular grains while concurrently introducing parallel twin planes in the same precipitation step. In other words, grain nucleation occurs under conditions that are conducive to twinning. The second approach is to form a stable grain nuclei population and then adjust the pAg of the interim emulsion to a level conducive to twinning.

Regardless of which approach is employed, it is advantageous to introduce the twin planes in the grain nuclei at an early stage of precipitation. It is contemplated to obtain a grain nuclei population containing parallel twin planes using less than 2 percent of the total silver used to form the tabular grain emulsion. It is usually convenient to use at least 0.05 percent of the total silver to form the parallel twin plane containing grain nuclei population, although this can be accomplished using even less of the total silver. The longer introduction of parallel twin planes is delayed after forming a stable grain nuclei population the greater is the tendency toward increased grain dispersity.

At the stage of introducing parallel twin planes in the grain nuclei, either during initial formation of the grain nuclei or immediately thereafter, the lowest attainable levels of grain dispersity in the completed emulsion are achieved by control of the dispersing medium.

The pAg of the dispersing medium is preferably maintained in the range of from 5.4 to 10.3 and, for achieving a COV of less than 10 percent, optimally in the range of from 7.0 to 10.0. At a pAg of greater than 10.3 a tendency toward increased tabular grain ECD and thickness dispersities is observed. Any convenient conventional technique for monitoring and regulating pAg can be employed.

Reductions in grain dispersities have also been observed as a function of the pH of the dispersing medium. Both the incidence of nontabular grains and the thickness dispersities of the nontabular grain population have been observed to decrease when the pH of the dispersing medium is less than 6.0 at the time parallel twin planes are being introduced into the grain nuclei. The pH of the dispersing medium can be regulated in any convenient conventional manner. A strong mineral acid, such as nitric acid, can be used for this purpose.

Grain nucleation and growth occurs in a dispersing medium comprised of water, dissolved salts and a conventional peptizer. Hydrophilic colloid peptizers such as gelatin and gelatin derivatives are specifically contemplated. Peptizer concentrations of from 20 to 800 (optimally 40 to 600) grams per mole of silver introduced during the nucleation step have been observed to produce emulsions of the lowest grain dispersity levels.

The formation of grain nuclei containing parallel twin planes is undertaken at conventional precipitation temperatures for photographic emulsions, with temperatures in the range of from 20° to 80° C. being particularly preferred and temperature of from 20° to 60° C. being optimum.

Once a population of grain nuclei containing parallel twin planes has been established as described above, the next step is to reduce the dispersity of the grain nuclei population by ripening. The objective of ripening grain nuclei containing parallel twin planes to reduce dispersity is disclosed by both Himmelwright U.S. Pat. No. 4,477,565 and Nottorf U.S. Pat. No. 4,722,886, the disclosures of which are here incorporated by reference. Ammonia and thioethers in concentrations of from about 0.01 to 0.1N constitute preferred ripening agent selections.

Instead of introducing a silver halide solvent to induce ripening it is possible to accomplish the ripening step by adjusting pH to a high level—e.g., greater than 9.0. A ripening process of this type is disclosed by Buntaine and Brady U.S. Ser. No. 452,487, filed Dec. 19, 1989, titled FORMATION OF TABULAR GRAIN SILVER HALIDE EMULSIONS UTILIZING HIGH pH DIGESTION, commonly assigned now U.S. Pat. No. 5,013,641. In this process the post nucleation ripening step is performed by adjusting the pH of the dispersing medium to greater than 9.0 by the use of a base, such as an alkali hydroxide (e.g., lithium, sodium or potassium hydroxide) followed by digestion for a short period (typically 3 to 7 minutes). At the end of the ripening step the emulsion is again returned to the acidic pH ranges conventionally chosen for silver halide precipitation (e.g. less than 6.0) by introducing a conventional acidifying agent, such as a a mineral acid (e.g., nitric acid).

Some reduction in dispersity will occur no matter how abbreviated the period of ripening. It is preferred to continue ripening until at least about 20 percent of the total silver has been solubilized and redeposited on the remaining grain nuclei. The longer ripening is extended the fewer will be the number of surviving nuclei. This means that progressively less additional silver halide precipitation is required to produce tabular grains of an aim ECD in a subsequent growth step. Looked at another way, extending ripening decreases the size of the emulsion make in terms of total grams of silver precipitated. Optimum ripening will vary as a function of aim emulsion requirements and can be adjusted as desired.

Once nucleation and ripening have been completed, further growth of the emulsions can be undertaken in any conventional manner consistent with achieving desired final mean grain thicknesses and ECDs. The halides introduced during grain growth can be selected independently of the halide selections for nucleation. The tabular grain emulsion can contain grains of either uniform or nonuniform silver halide composition. Although the formation of grain nuclei incorporates bromide ion and only minor amounts of chloride and/or iodide ion, the low dispersity tabular grain emulsions produced at the completion of the growth step can contain in addition to bromide ions any one or combination of iodide and chloride ions in any proportions found in tabular grain emulsions. If desired, the growth of the tabular grain emulsion can be completed in such a manner as to form a core-shell emulsion of reduced dispersity. The shelling procedure taught by Evans et al U.S. Pat. No. 4,504,570, issued Mar. 12, 1985, is here incorporated by reference. Internal doping of the tabular grains, such as with group VIII metal ions or coordination complexes, conventionally undertaken to obtain improved reversal and other photographic properties are specifically contemplated. For optimum levels of dispersity it is, however, preferred to defer doping until after the grain nuclei containing parallel twin planes have been obtained.

In optimizing the process of this invention for minimum tabular grain dispersity levels (COV less than 10 percent) it has been observed that optimizations differ as a function of iodide incorporation in the grains as well as the choices of surfactants and/or peptizers.

While any conventional hydrophilic colloid peptizer can be employed in the practice of this invention, it is preferred to employ gelatino-peptizers during precipitation. Gelatino-peptizers are commonly divided into so-called "regular" gelatino-peptizers and so-called "oxidized" gelatino-peptizers. Regular gelatino-peptizers are those that contain naturally occurring amounts of methionine of at least 30 micromoles of methionine per gram and usually considerably higher concentrations. The term oxidized gelatino-peptizer refers to gelatino-peptizers that contain less than 30 micromoles of methionine per gram. A regular gelatino-peptizer is converted to an oxidized gelatino-peptizer when treated with a strong oxidizing agent, such as taught by Maskasky U.S. Pat. No. 4,713,323 and King et al U.S. Pat. No. 4,942,120, the disclosures of which are here incorporated by reference. The oxidizing agent attacks the divalent sulfur atom of the methionine moiety, converting it to a tetravalent or, preferably, hexavalent form. While methionine concentrations of less than 30 micromoles per gram have been found to provide oxidized gelatino-peptizer performance characteristics, it is preferred to reduce methionine concentrations to less than 12 micromoles per gram. Any efficient oxidation will generally reduce methionine to less than detectable levels. Since gelatin in rare instances naturally contains low levels of methionine, it is recognized that the terms "regular" and "oxidized" are used for convenience of expression while the true distinguishing feature is methionine level rather than whether or not an oxidation step has been performed.

When an oxidized gelatino-peptizer is employed, it is preferred to maintain a pH during twin plane formation of less than 5.2 to achieve a minimum (less than 10 percent) COV. When a regular gelatino-peptizer is employed, the pH during twin plane formation is maintained at less than 3.0 to achieve a minimum COV.

When regular gelatin and a category S-I surfactant are each employed prior to post-ripening grain growth, the category S-I surfactant is selected so that the hydrophilic block (e.g., HAO1) accounts for 4 to 96 (preferably 5 to 85 and optimally 10 to 80) percent of the total surfactant molecular weight. It is preferred that x and x' (in formula II) be at least 6 and that the minimum molecular weight of the surfactant be at least 760 and optimally at least 1000, with maximum molecular weights ranging up to 16,000, but preferably being less than 10,000.

When the category S-I surfactant is replaced by a category S-II surfactant, the latter is selected so that the lipophilic block (e.g., LAO2) accounts for 4 to 96 (preferably 15 to 95 and optimally 20 to 90) percent of the total surfactant molecular weight. It is preferred that x (formula IV) be at least 13 and that the minimum molecular weight of the surfactant be at least 800 and optimally at least 1000, with maximum molecular weights ranging up to 30,000, but preferably being less than 20,000.

When a category S-III surfactant is selected for this step, it is selected so that the lipophilic alkylene oxide block linking unit (LOL) accounts for 4 to 96 percent, preferably 15 to 95 percent, and optimally 20 to 90 percent of the total surfactant molecular weight. In the ethylene oxide and 1,2-propylene oxide forms shown in formula (XIIIa), x can range from 3 to 250 and y can range from 1 to 340 and the minimum molecular weight of the surfactant is greater than 1,100 and optimally at least 2,000, with maximum molecular weights ranging up to 60,000, but preferably being less than 40,000. The concentration levels of surfactant are preferably restricted as iodide levels are increased.

When a category S-IV surfactant is selected for this step, it is selected so that the hydrophilic alkalylene oxide block linking unit (HOL) accounts for 4 to 96 percent, preferably 5 to 85 percent, and optimally 10 to 80 percent of the total surfactant molecular weight. In the ethylene oxide and 1,2-propylene oxide forms shown in formula (XIIIb), x can range from 3 to 250 and y can range from 1 to 340 and the minimum molecular weight of surfactant is greater than 1,100 and optimally at least 2,000, with maximum molecular weights ranging up to 50,000, but preferably being less than 30,000.

When oxidized gelatino-peptizer is employed prior to post-ripening grain growth and no iodide is added during the post-ripening grain growth step, minimum COV emulsions can be prepared with category S-I surfactants chosen so that the hydrophilic block (e.g., HAO1) accounts for 4 to 35 (optimally 10 to 30) percent of the total surfactant molecular weight. The minimum molecular weight of the surfactant continues to be determined by the minimum values of x and x' (formula II) of 6. In optimized forms x and x' (formula II) are at least 7. Minimun COV emulsions can be prepared with category S-II surfactants chosen so that the lipophilic block (e.g., LAO2) accounts for 40 to 96 (optimally 60 to 90) percent of the total surfactant molecular weight. The minimum molecular weight of the surfactant continues to be determined by the minimum value of x (formula IV) of 13. The same molecular weight ranges for both category S-I and S-II surfactants are applicable as in using regular gelatino-peptizer as described above.

The polyalkylene oxide block copolymer surfactant can, if desired, be removed from the emulsion after it has been fully prepared. Any convenient conventional washing procedure, such as those illustrated by *Research Disclosure, Vol.* 308, Dec., 1989, Item 308,119, Section II, can be employed. The polyalkylene oxide block copolymer surfactant constitutes a detectable component of the final emulsion when present in concentrations greater than 0.02 percent, based on the total weight of silver.

Apart from the features that have been specifically discussed the tabular grain emulsion preparation procedures, the tabular grains that they produce, and their further use in photography can take any convenient conventional form. Such conventional features are illustrated by the following incorporated by reference disclosures:

| | |
|---|---|
| ICBR-1 | Research Disclosure, Vol. 308, December 1989, Item 308,119; |
| ICBR-2 | Research Disclosure, Vol. 225, January 1983, Item 22,534; |
| ICBR-3 | Wey et al U.S. Pat. No. 4,414,306, issued Nov. 8, 1983; |
| ICBR-4 | Solberg et al U.S. Pat. No. 4,433,048, issued Feb. 21, 1984; |
| ICBR-5 | Wilgus et al U.S. Pat. No. 4,434,226, issued Feb. 28, 1984; |
| ICBR-6 | Maskasky U.S. Pat. No. 4,435,501, issued Mar. 6, 1984; |
| ICBR-7 | Kofron et al U.S. Pat. No. 4,439,520, issued Mar. 27, 1987; |
| ICBR-8 | Maskasky U.S. Pat. No. 4,643,966, issued Feb. 17, 1987; |
| ICBR-9 | Daubendiek et al U.S. Pat. No. 4,672,027, issued Jan. 9, 1987; |
| ICBR-10 | Daubendiek et al U.S. Pat. No. 4,693,964, issued Sept. 15, 1987; |
| ICBR-11 | Maskasky U.S. Pat. No. 4,713,320, issued Dec. 15, 1987; |
| ICBR-12 | Saitou et al U.S. Pat. No. 4,797,354, issued Jan. 10, 1989; |
| ICBR-13 | Ikeda et al U.S. Pat. No. 4,806,461, issued Feb. 21, 1989; |
| ICBR-14 | Makino et al U.S. Pat. No. 4,853,322, issued Aug. 1, 1989; and |
| ICBR-15 | Daubendiek et al U.S. Pat. No. 4,914,014, issued Apr. 3, 1990. |

EXAMPLES

The invention can be better appreciated by reference to the following specific examples.

EXAMPLE 1 (AKT-527)

This example has as its purpose to demonstrate a tabular grain silver bromide emulsion having a very low coefficient of variation.

In a 4-liter reaction vessel was placed an aqueous gelatin solution (composed of 1 liter of water, 0.41 g of oxidized alkali-processed gelatin, 4.2 ml of 4N nitric acid solution, 0.63 g of sodium bromide and having a pAg of 9.15, and 48.87%, based on the total weight of silver introduced, of PLURONIC TM -31R1, a surfactant satisfying formula II, x=25, x'=25, y=7) and while keeping the temperature thereof at 45° C., 2.75 ml of an aqueous solution of silver nitrate (containing 0.37 g of silver nitrate) and 2.83 ml of an aqueous solution of sodium bromide (containing 0.23 g of sodium bromide) were simultaneously added thereto over a period of 1 minute at a constant rate. Then, into the mixture was added 19.2 ml of an aqueous sodium bromide solution (containing 1.98 g of sodium bromide) after 1 minute of mixing. Temperature of the mixture was raised to 60° C. over a period of 9 minutes. At that time, 43.3 ml of an aqueous ammoniacal solution (containing 3.37 g of ammonium sulfate and 26.7 ml of 2.5N sodium hydroxide solution) was added into the vessel and mixing was conducted for a period of 9 minutes. Then, 94.2 ml of an aqueous gelatin solution (containing 16.7 g of oxidized alkali-processed gelatin and 10.8 ml of 4N nitric acid solution) was added to the mixture over a period of 2 minutes. After then, 7.5 ml of an aqueous silver nitrate solution (containing 1.02 g of silver nitrate) and 8.3 ml of an aqueous sodium bromide solution (containing 0.68 g of sodium bromide) were added at a constant rate for a period of 5 minutes. Then, 474.7 ml of an aqueous silver nitrate solution (containing 129 g of silver nitrate) and equal amount of an aqueous sodium bromide solution (containing 82 g of sodium bromide) were simultaneously added to the aforesaid mixture at constant ramp starting from respective rate of 1.5 ml/min and 1.62 ml/min for the subsequent 64 minutes. Then, 253.3 ml of an aqueous silver nitrate solution (containing 68.8 g of silver nitrate) and 252 ml of an aqueous sodium bromide solution (containing 43.5 g of sodium bromide) were simultaneously added to the aforesaid mixture at constant rate over a period of 19 minutes. The silver halide emulsion thus obtained was washed.

The properties of grains of this emulsion were found to be as follows: Average Grain ECD: 2.20 μm Average Grain Thickness: 0.113 μm Tabular Grain Projected Area: approx. 100% Average Aspect Ratio of the Grains: 19.5 Average Tabularity of the Grains: 173 Coefficient of Variation of Total Grains: 4.7%

EXAMPLE 2 (AKT-550)

This example has as its purpose to demonstrate a higher tabularity emulsion having a very low coefficient of variation.

In a 4-liter reaction vessel was placed an aqueous gelatin solution (composed of 1 liter of water, 0.16 g of oxidized alkali-processed gelatin, 4.2 ml of 4N nitric acid solution, 1.12 g of sodium bromide and having a pAg of 9.39, and 99.54%, based on the total weight of silver introduced, of PLURONICTM TM -31R1 as a surfactant) and while keeping the temperature thereof at 45° C., 3.33 ml of an aqueous solution of silver nitrate (containing 0.14 g of silver nitrate) and equal amount of an aqueous solution of sodium bromide (containing 0.086 g of sodium bromide) were simultaneously added thereto over a period of 1 minute at a constant rate. Then, into the mixture was added 14.2 ml of an aqueous sodium bromide solution (containing 1.46 g of sodium bromide) after 1 minute of mixing. Temperature of the mixture was raised to 60° C. over a period of 9 minutes. At that time, 32.5 ml of an aqueous ammonium solution (containing 1.68 g of ammonium sulfate and 15.8 ml of 2.5N sodium hydroxide solution) was added into the vessel and mixing was conducted for a period of 9 minutes. Then, 88.8 ml of an aqueous gelatin solution (containing 12.5 g of oxidized alkali-processed gelatin and 5.5 ml of 4N nitric acid solution) was added to the mixture over a period of 2 minutes. After then, 30 ml of an aqueous silver nitrate solution (containing 1.27 g of silver nitrate) and 37.8 ml of an aqueous sodium bromide solution (containing 0.97 g of sodium bromide) were added at a constant rate for a period of 15 minutes. Then, 113.3 ml of an aqueous silver nitrate solution (containing 30.8 g of silver nitrate) and 110.3 ml of an aqueous sodium bromide solution (containing 19.9 g of sodium bromide) were simultaneously added to the aforesaid mixture at constant ramp starting from respective rate of 0.67 ml/min and 0.72 ml/min for the subsequent 40 minutes. Thereafter, 7.5 ml of an aqueous sodium bromide solution (containing 1.35 g of sodium bromide) was added to the mixture. Then, 633.1 ml of an aqueous silver nitrate solution (containing 172.1 g of silver nitrate) and 612.9 ml of an aqueous sodium bromide solution (containing 110.4 g of sodium bromide) were simultaneously added to the aforesaid mixture at constant rate over a period of 71.4 minutes. The silver halide emulsion thus obtained was washed.

The properties of grains of this emulsion were found to be as follows: Average Grain ECD: 3.70 μm Average Grain Thickness: 0.091 μm Tabular Grain Projected Area: approx. 100% Average Aspect Ratio of the Grains: 40.7 Average Tabularity of the Grains: 447 Coefficient of Variation of Total Grains: 9%

EXAMPLE 3 (AKT-615)

The purpose of this example is to demonstrate a silver bromoiodide emulsion prepared with iodide run in during post-ripening growth step and exhibiting a very low COV.

In a 4-liter reaction vessel was placed an aqueous gelatin solution (composed of 1 liter of water, 1.3 g of alkali-processed gelatin, 4.2 ml of 4N nitric acid solution, 2.44 g of sodium bromide and having pAg of 9.71, and 2.76%, based on the total weight of silver introduced, of PLURONIC TM -17R1, a surfactant satisfying formula II, x=15, x'=15, y=4) and while keeping the temperature thereof at 45° C., 13.3 ml of an aqueous solution of silver nitrate (containing 1.13 g of silver nitrate) and equal amount of an aqueous solution of sodium bromide (containing 0.69 g of sodium bromide) were simultaneously added thereto over a period of 1 minute at a constant rate. Then, into the mixture was added 14.2 ml of an aqueous sodium bromide solution (containing 1.46 g of sodium bromide) after 1 minute of mixing. Temperature of the mixture was raised to 60° C. over a period of 9 minutes. At that time, 33.5 ml of an aqueous ammoniacal solution (containing 1.68 g of ammonium sulfate and 16.8 ml of 2.5N sodium hydroxide solution) was added into the vessel and mixing was conducted for a period of 9 minutes. Then, 88.8 ml of an aqueous gelatin solution (containing 16.7 g of alkali-processed gelatin and 5.5 ml of 4N nitric acid solution) was added to the mixture over a period of 2 minutes. After then, 83.3 ml of an aqueous silver nitrate solution (containing 22.64 g of silver nitrate) and 78.7 ml of an aqueous halide solution (containing 12.5 g of sodium bromide and 2.7 g of potassium iodide) were added at a constant rate for a period of 40 minutes. Then, 299 ml of an aqueous silver nitrate solution (containing 81.3 g of silver nitrate) and 284.1 ml of an aqueous halide solution (containing 45 g of sodium bromide and 9.9 g of potassium iodide) were simultaneously added to the aforesaid mixture at constant ramp starting from respective rate of 2.08 ml/min and 2.05 ml/min for the subsequent 35 minutes. Then, 349 ml of an aqueous silver nitrate solution (containing 94.9 g of silver nitrate) and 330 ml of an aqueous halide solution (containing 52.3 g of sodium bromide and 11.5 g of potassium iodide) were simultaneously added to the aforesaid mixture at constant rate over a period of 23.3 minutes. The silver halide emulsion thus obtained contained 12.4 mole % of iodide.

The properties of grains of this emulsion were found to be as follows: Average Grain ECD: 1.10 μm Average Grain Thickness: 0.211 μm Tabular Grain Projected Area: approx. 100% Average Aspect Ratio of the Grains: 5.2 Average Tabularity of the Grains: 24.6 Coefficient of Variation of Total Grains: 8.2%

EXAMPLE 4 (MK-92)

The purpose of this example is to demonstrate a very low coefficient of variation silver bromoiodide emulsion prepared by dumping iodide into the reaction vessel during the post-ripening grain growth step.

In a 4-liter reaction vessel was placed an aqueous gelatin solution having a pAg of 9.72 composed of 1 liter of water, 1.3 g of alkali-processed gelatin, 4.2 ml of 4N nitric acid solution, 2.5 g of sodium bromide, and PLURONIC TM -31R1, a surfactant which satisfies formula II, x=25, x'=25, y=7. The surfactant constituted 15.76 percent by weight of the total silver introduced up to the beginning of the post-ripening grain growth step. While keeping the temperature thereof at 40° C., 13.3 ml of an aqueous solution of silver nitrate (containing 1.13 g of silver nitrate) and equal amount of an aqueous halide solution (containing 0.69 g of sodium bromide and 0.0155 g of potassium iodide) were simultaneously added thereto over a period of 1 minute at a constant rate. Then, into the mixture was added 14.2 ml of an aqueous sodium bromide solution (containing 1.46 g of sodium bromide) after 1 minute of mixing. Temperature of the mixture was raised to 50° C. over a period of 6 minutes after 1 minute of mixing. Thereafter, 32.5 ml of an aqueous ammoniacal solution (containing 1.68 g of ammonium sulfate and 15.8 ml of 2.5N sodium hydroxide solution) was added into the vessel and mixing was conducted for a period of 9 minutes. Then, 83.3 ml of an aqueous gelatin solution (containing 25.0 g of alkali-processed gelatin and 5.5 ml of 4N nitric acid solution) were added to the mixture over a period of 2 minutes. After then, 83.3 ml of an aqueous silver nitrate solution (containing 22.64 g of silver nitrate) and 84.7 ml of an aqueous halide solution (containing 14.5 g of sodium bromide and 0.236 g of potassium iodide) were added at a constant rate for a period of 40 minutes. Then, 299 ml of an aqueous silver nitrate solution (containing 81.3 g of silver nitrate) and 298 ml of an aqueous halide solution (containing 51 g of sodium bromide and 0.831 g of potassium iodide) were simultaneously added to the aforesaid mixture at constant ramp starting from respective rate of 2.08 ml/min and 2.12 ml/min for the subsequent 35 minutes. Then, 128 ml of an aqueous silver nitrate solution (containing 34.8 g of silver nitrate) and 127 ml of an aqueous halide solution (containing 21.7 g of sodium bromide and 0.354 g of potassium iodide) were simultaneously added to the aforesaid mixture at constant rate over a period of 8.5 minutes. An iodide solution in the amount of 125 cc containing 3.9 g potassium iodide was added at rate of 41.7 cc/min for 3 minutes followed by a 2 minute hold under unvaried conditions. Thereafter, 221 ml of an aqueous silver nitrate solution (containing 60 g of silver nitrate) and equal amount of an aqueous halide solution (containing 38.2 g of sodium bromide) were simultaneously added to the aforesaid mixture at a constant rate over a period of 16.6 minutes. The silver halide emulsion thus obtained contained 2.7 mole % of iodide.

The properties of grains of this emulsion were found to be as follows: Average Grain ECD: 0.65 μm Average Grain Thickness: 0.269 μm Tabular Grain Projected Area: approx. 100% Average Aspect Ratio of the Grains: 2.4 Average Tabularity of the Grains: 9 Coefficient of Variation of Total Grains: 9.9%

EXAMPLE 5 (AKT-711D)

The purpose of this example is to illustrate a process of tabular grain emulsion preparation that results in a small average ECD and a very low COV.

In a 4-liter reaction vessel was placed an aqueous gelatin solution (composed of 1 liter of water, 0.83 g of oxidized alkali-processed gelatin, 3.8 ml of 4N nitric acid solution, 1.12 g of sodium bromide and having pAg of 9.39, and 7.39 wt. %, based on total silver used in nucleation, of PLURONIC TM -31R1 surfactant) and while keeping the temperature thereof at 45° C., 10.67 ml of an aqueous solution of silver nitrate (containing 1.45 g of silver nitrate) and equal amount of an aqueous solution of sodium bromide (containing 0.92 g of sodium bromide) were simultaneously added thereto over a period of 1 minute at a constant rate. Then, into the mixture was added 14.2 ml of an aqueous sodium bromide solution (containing 1.46 g of sodium bromide) after 1 minute of mixing. Temperature of the mixture was raised to 60° C. over a period of 9 minutes. At that time, 43.3 ml of an aqueous ammoniacal solution (containing 3.36 g of ammonium sulfate and 26.7 ml of 2.5N sodium hydroxide solution) was added into the vessel and mixing was conducted for a period of 9 minutes. Then, 178 ml of an aqueous gelatin solution (containing 16.7 g of oxidized alkali-processed gelatin, 11.3 ml of 4N nitric acid solution and 0.11 g of Pluronic TM -31R1 surfactant) was added to the mixture over a period of 2 minutes. After then, 7.5 ml of an aqueous silver nitrate solution (containing 1.02 g of silver nitrate) and 7.7 ml of an aqueous sodium bromide solution (containing 0.66 g of sodium bromide) were added at a constant rate for a period of 5 minutes. Then, 79.6 ml of an aqueous silver nitrate solution (containing 21.6 g of silver nitrate) and an equal amount of an aqueous sodium bromide solution (containing 82 g of sodium bromide) were simultaneously added to the aforesaid mixture at constant ramp starting from respective rate of 1.5 ml/min and 1.62 ml/min for the subsequent 22.3 minutes. The silver halide emulsion thus obtained was washed.

The properties of grains of this emulsion were found to be as follows: Average Grain ECD: 0.48 μm Average Grain Thickness: 0.088 μm Tabular Grain Projected Area: approx. 100% Average Aspect Ratio of the Grains: 5.5 Average Tabularity of the Grains: 62 Coefficient of Variation of Total Grains: 9.6%

EXAMPLES 6 AND 7

The purpose of these examples is to demonstrate the effect of a category S-I surfactant on achieving a low level of dispersity.

EXAMPLE 6 (A CONTROL) (AKT-702)

In a 4-liter reaction vessel was placed an aqueous gelatin solution (composed of 1 liter of water, 1.3 g of oxidized alkali-processed gelatin, 4.2 ml of 4N nitric acid solution, 0.035 g of sodium bromide and having a pAg of 7.92) and while keeping the temperature thereof at 45° C., 13.3 ml of an aqueous solution of silver nitrate (containing 1.13 g of silver nitrate) and a balancing molar amount of an aqueous solution of sodium bromide and sodium iodide (containing 0.677 g of sodium bromide and 0.017 g of sodium iodide) were simultaneously added thereto over a period of 1 minute at a constant rate. Then, into the mixture was added 24.2 ml of an aqueous sodium bromide solution (containing 2.49 g of sodium bromide) after 1 minute of mixing. Temperature of the mixture was raised to 60° C. over a period of 9 minutes. At that time, 33.5 ml of an aqueous ammoniacal solution (containing 1.68 g of ammonium sulfate and 16.8 ml of 2.5N sodium hydroxide solution) was added into the vessel and mixing was conducted for a period of 9 minutes. Then, 88.8 ml of an aqueous gelatin solution (containing 16.7 g of oxidized alkali-processed gelatin and 5.5 ml of 4N nitric acid solution) was added to the mixture over a period of 2 minutes. After then, 83.3 ml of an aqueous silver nitrate solution (containing 22.64 g of silver nitrate) and 81.3 ml of an aqueous sodium bromide solution (containing 14.6 g of sodium bromide) were added at a constant rate for a period of 40 minutes. Then, 299 ml of an aqueous silver nitrate solution (containing 81.3 g of silver nitrate) and 285.3 ml of an aqueous sodium bromide solution (containing 51.4 g of sodium bromide) were simultaneously added to the aforesaid mixture at constant ramp starting from respective rate of 2.08 ml/min and 2.07 ml/min for the subsequent 64 minutes. Then, 349 ml of an aqueous silver nitrate solution (containing 94.9 g of silver nitrate) and 331.9 ml of an aqueous sodium bromide solution (containing 59.8 g of sodium bromide) were simultaneously added to the aforesaid mixture at constant rate over a period of 23.3 minutes. The silver halide emulsion thus obtained was washed.

The properties of grains of this emulsion were found to be as follows: Average Grain ECD: 4.80 μm Average Grain Thickness: 0.086 μm Tabular Grain Projected Area: approx. 100% Average Aspect Ratio of the Grains: 55.8 Average Tabularity of the Grains: 649 Coefficient of Variation of Total Grains: 36.1%

EXAMPLE 7 (AKT-244)

Example 6 was repeated, except that PLURONIC TM -31R1, a surfactant satisfying formula II, x=25, x'=25, y=7, was additionally present in the reaction vessel prior to the introduction of silver salt. The surfactant constituted of 12.28 percent by weight of the total silver introduced up to the beginning of the post-ripening grain growth step.

The properties of the grains of this emulsion were found to be as follows: Average Grain ECD: 1.73 μm Average Grain Thickness: 0.093 μm Tabular Grain Projected Area: approx. 100% Average Aspect Ratio of the Grains: 18.6 Average Tabularity of the Grains: 200 Coefficient of Variation of Total Grains: 7.5%

FIG. 3 is a photomicrograph of the emulsion of Example 7. Light from a tungsten light source was used to illuminate the grains. Light reflected from the tabular grains that do not overlap another tabular grain appear similar in hue, with differences in hue being limited the overlapping tabular grains. Since the hue (wavelength) of reflected light is related to the thicknesses of tabular grains, it is apparent that the tabular grains of the emulsion of Example 7 prepared in the presence of a surfactant exhibited little grain-to-grain variance in thickness, account for substantially the entire grain population, and exhibit only small variances in ECDs.

EXAMPLE 8 (AKT-612)

The purpose of this example is to illustrate the preparation of a very low coefficient of variation tabular grain emulsion employing a category S-II surfactant.

In a 4-liter reaction vessel was placed an aqueous gelatin solution (composed of 1 liter of water, 1.3 g of alkali-processed gelatin, 4.2 ml of 4N nitric acid solution, 2.44 g of sodium bromide and having a pAg of 9.71 and 1.39 wt %, based on total silver used in nucleation, of PLURONIC TM -L63, a surfactant satisfying formula IV, x=32, y=9, y'=9) and while keeping the temperature thereof at 45° C., 13.3 ml of an aqueous solution of silver nitrate (containing 1.13 g of silver nitrate) and equal amount of an aqueous solution of sodium bromide (containing 0.69 g of sodium bromide) were simultaneously added thereto over a period of 1 minute at a constant rate. Thereafter, after 1 minute of mixing, the temperature of the mixture was raised to 60° C. over a period of 9 minutes. At that time, 33.5 ml of an aqueous ammoniacal solution (containing 1.68 g of ammonium sulfate and 16.8 ml of 2.5N sodium hydroxide solution) was added into the vessel and mixing was conducted for a period of 9 minutes. Then, 88.8 ml of an aqueous gelatin solution (containing 16.7 g of alkali-processed gelatin and 5.5 ml of 4N nitric acid solution) was added to the mixture over a period of 2 minutes. After then, 83.3 ml of an aqueous silver nitrate solution (containing 22.64 g of silver nitrate) and 80 ml of an aqueous halide solution (containing 14 g of sodium bromide and 0.7 g of potassium iodide) were added at a constant rate for a period of 40 minutes. Then, 299 ml of an aqueous silver nitrate solution (containing 81.3 g of silver nitrate) and 285.3 ml of an aqueous halide solution (containing 49.8 g of sodium bromide and 2.5 g of potassium iodide) were simultaneously added to the aforesaid mixture at constant ramp starting from respective rate of 2.08 ml/min and 2.07 ml/min for the subsequent 35 minutes. Then, 349 ml of an aqueous silver nitrate solution (containing 94.9 g of silver nitrate) and 331.1 ml of an aqueous halide solution (containing 57.8 g of sodium bromide and 2.9 g of potassium iodide) were simultaneously added to the aforesaid mixture at constant rate over a period of 23.3 minutes. The silver halide emulsion thus obtained contained 3.1 mole % of iodide. The emulsion was then washed.

The properties of grains of this emulsion were found to be as follows: Average grain ECD: 1.14 μm Average Grain Thickness: 0.179 μm Tabular Grain Projected Area: approx. 100% Average Aspect Ratio of the Grains: 6.4 Average Tabularity of the Grains: 35.8 Coefficient of Variation of Total Grains: 6.0%

EXAMPLES 9 AND 10

The purpose of these examples is to demonstrate the effectiveness of a category S-III surfactant in achieving a very low level of dispersity in a tabular grain emulsion.

EXAMPLE 9 (A CONTROL) (MK-103)

No surfactant was employed.

In a 4-liter reaction vessel was placed an aqueous gelatin solution (composed of 1 liter of water, 1.3 g of alkali-processed gelatin, 4.2 ml of 4N nitric acid solution, 2.5 g of sodium bromide and having a pAg of 9.72) and while keeping the temperature thereof at 45° C., 13.3 ml of an aqueous solution of silver nitrate (containing 1.13 g of silver nitrate) and equal amount of an aqueous solution of sodium bromide (containing 0.69 g of sodium bromide) were simultaneously added thereto over a period of 1 minute at a constant rate. Then, into the mixture was added 14.2 ml of an aqueous sodium bromide solution (containing 1.46 g of sodium bromide) after 1 minute of mixing. Temperature of the mixture was raised to 60° C. over a period of 9 minutes after 1 minute of mixing. Thereafter, 32.5 ml of an aqueous ammoniacal solution (containing 1.68 g of ammonium sulfate and 15.8 ml of 2.5N sodium hydroxide solution) was added into the vessel and mixing was conducted for a period of 9 minutes. Then, 172.2 ml of an aqueous gelatin solution (containing 41.7 g of alkali-processed gelatin and 5.5 ml of 4N nitric acid solution) was added to the mixture over a period of 2 minutes. After then, 83.3 ml of an aqueous silver nitrate solution (containing 22.64 g of silver nitrate) and 84.7 ml of an aqueous halide solution (containing 14.2 g of sodium bromide and 0.71 g of potassium iodide) were added at a constant rate for a period of 40 minutes. Then, 299 ml of an aqueous silver nitrate solution (containing 81.3 g of silver nitrate) and 298 ml of an aqueous halide solution (containing 50 g of sodium bromide and 2.5 g of potassium iodide) were simultaneously added to the aforesaid mixture at constant ramp starting from respective rate of 2.08 ml/min and 2.12 ml/min for the subsequent 35 minutes. Then, 128 ml of an aqueous silver nitrate solution (containing 34.8 g of silver nitrate) and 127 ml of an aqueous halide solution (containing 21.3 g of sodium bromide and 1.07 g of potassium iodide) were simultaneously added to the aforesaid mixture at constant rate over a period of 8.5 minutes. Thereafter, 221 ml of an aqueous silver nitrate solution (containing 60 g of silver nitrate) and equal amount of an aqueous sodium bromide solution (containing 37.1 g of sodium bromide and 1.85 g of potassium iodide) were simultaneously added to the aforesaid mixture at constant rate over a period of 16.6 minutes. The silver halide emulsion thus obtained contained 3 mole % of iodide.

The properties of grains of this emulsion were found to be as follows:

Average Grain ECD: 1.81 μm
Average Grain Thickness: 0.122 μm
Tabular Grain Projected Area: approx. 100%
Average Aspect Ratio of the Grains: 14.8
Average Tabularity of the Grains: 121
Coefficient of Variation of Total Grains: 29.5%.

EXAMPLE 10 (MK-162)

Example 9 was repeated, except that

Example 9 was repeated, except that

TETRONIC TM —1508,
N,N,N',N'-tetrakis $\{H(OCH_2CH_2)_y[OCH(CH_3)CH_2-]_x\}$ ethylenediamine surfactant, x=26, y=136, was additionally present in the reaction vessel prior to the introduction of silver salt. The surfactant constituted of 11.58 percent by weight of the total silver introduced prior to the post-ripening grain growth step.

The properties of grains of this emulsion were found to be as follows:

Average Grain ECD: 1.20 μm
Average Grain Thickness: 0.183 μm
Tabular Grain Projected Area: approx. 100%
Average Aspect Ratio of the Grains: 6.6
Average Tabularity of the Grains: 36.1
Coefficient of Variation of Total Grains: 9.1% From viewing the reflectances of the tabular grains of the emulsions of Examples 9 and 10 it was apparent that the Example 10 tabular grain exhibited significantly less grain to grain variations in thickness.

EXAMPLE 11 (MK-179)

The purpose of this example is to demonstrate the effectiveness of a category S-IV surfactant in achieving a very low level of dispersity in a tabular grain emulsion.

Example 10 was repeated, except that

Example 10 was repeated, except that

TETRONIC TM —150R8,
N,N,N',N'-tetrakis $\{H[OCH(CH_3)CH_2]_x(OCH_2CH_2)_y-\}$ ethylenediamine surfactant, x=18, y=92, was additionally present in the reaction vessel prior to the introduction of silver salt. The surfactant constituted 2.32 percent by weight of the total silver introduced prior to the post-ripening grain growth step.

The properties of grains of this emulsion were found to be as follows:

Average Grain ECD: 1.11 μm
Average Grain Thickness: 0.255 μm
Tabular Grain Projected Area: approx. 100%
Average Aspect Ratio of the Grains: 4.4
Average Tabularity of the Grains: 17
Coefficient of Variation of Total Grains: 9.6%

EXAMPLE 12 (AKT-761, 1% with Ir)

In a 4-liter reaction vessel was placed an aqueous gelatin solution (composed of 1 liter of water, 1 g of alkali-processed gelatin, 1 ml of 4N nitric acid solution, 2.44 g of sodium bromide and having pAg of 9.71, and 3.47 wt %, based on total silver introduced up to the beginning of post-ripening grain growth stage, of PLURONIC-L63, a surfactant satisfying formula IV, x=32, y=9, y'=9) and while keeping the temperature thereof at 45 C., 6.7 ml of an aqueous solution of silver nitrate (containing 0.91 g of silver nitrate) and equal volume of an aqueous solution of sodium bromide (containing 0.63 g of sodium bromide) were simultaneously added thereto over a period of 1 minute at a constant rate.

After 1 minute of mixing, temperature of the mixture was raised to 60° C. over a period of 9 minutes. At that time, 28.5 ml of an aqueous ammoniacal solution (containing 1.68 g of ammonia sulfate and 11.8 ml of 2.5N sodium hydroxide solution) was added into the vessel and mixing was conducted for a period of 9 minutes. Thereafter, 88.7 ml of an aqueous gelatin solution (containing 16.7 g of alkali-processed gelatin and 5.3 ml of 4N nitric acid solution) was added to the mixture over a period of 2 minutes. 0.235 mg of potassium hexachloroiridate (IV) was subsequently introduced over a period of 30 sec. After then, 7.5 ml of an aqueous silver nitrate solution (containing 1.0 g of silver nitrate) and 7.3 ml of an aqueous sodium bromide solution (containing 0.68 g of sodium bromide) were added at a constant rate for a period of 5 minutes. Then, 474.7 ml of an aqueous silver nitrate solution (containing 129 g of silver nitrate) and 473.6 ml of an aqueous halide solution (containing 81 g of sodium bromide and 1.3 g of potassium iodide) were simultaneously added to the aforesaid mixture at constant ramp starting from respective rate of 1.5 ml/min and 1.6 ml/min for the subsequent 64 minutes. Then, 253.3 ml of an aqueous silver nitrate solution (containing 68.9 g of silver nitrate) and 251.1 ml of an aqueous halide solution (containing 43 g of sodium bromide and 0.7 g of potassium iodide) were simultaneously added to the aforesaid mixture at constant rate over a period of 19 minutes. The silver halide emulsion thus obtained contained 1 mole % of iodide and $4.3\times10^{-7}$ mole of potassium hexachloroiridate (IV) per silver mole. The properties of grains of this emulsion are as follows:

Average Grain ECD: 1.33 μm
Average Grain Thickness: 0.159 μm
Average Aspect Ratio of the Grains: 8.4
Average Tabularity of the Grains: 52.6
Coefficient of Variation of Total Grains: 7.7%

EXAMPLE 13 (AKT-762, 1% I with Se)

In a 4-liter reaction vessel was placed an aqueous gelatin solution (composed of 1 liter of water, 1 g of alkali-processed gelatin, 1 ml of 4N nitric acid solution, 2.44 g of sodium bromide and having pAg of 9.71, and 3.47 wt %, based on total silver introduced up to the beginning of post-ripening grain growth stage, of PLURONIC-L63, a surfactant satisfying formula IV, x=32, y=9, y'=9) and while keeping the temperature thereof at 45° C., 6.7 ml of an aqueous solution of silver nitrate (containing 0.91 g of silver nitrate) and equal volume of an aqueous solution of sodium bromide (containing 0.63 g of sodium bromide) were simultaneously added thereto over a period of 1 minute at a constant rate. After 1 minute of mixing, temperature of the mixture was raised to 60 C. over a period of 9 minutes. At that time, 28.5 ml of an aqueous ammoniacal solution (containing 1.68 g of ammonia sulfate and 11.8 ml of 2.5N sodium hydroxide solution) was added into the vessel and mixing was conducted for a period of 9 minutes. Thereafter, 88.7 ml of an aqueous gelatin solution (containing 16.7 g of alkali-processed gelatin and 5.3 ml of 4N nitric acid solution) was added to the mixture over a period of 2 minutes. After then, 7.5 ml of an aqueous silver nitrate solution (containing 1.0 g of silver nitrate) and 7.3 ml of an aqueous sodium bromide solution (containing 0.68 g of sodium bromide) were added at a constant rate for a period of 5 minutes. Then, 474.7 ml of an aqueous silver nitrate solution (containing 129 g of silver nitrate) and 473.6 ml of an aqueous halide solution (containing 81 g of sodium bromide and 1.3 g of potassium iodide) were simultaneously added to the aforesaid mixture at constant ramp starting from respective rate of 1.5 ml/min and 1.6 ml/min for the subsequent 64 minutes. Then, 226.6 ml of an aqueous silver nitrate solution (containing 61.6 g of silver nitrate) and 224.7 ml of an aqueous halide solution (containing 38.5 g of sodium bromide and 0.63 g of potassium iodide) were simultaneously added to the aforesaid mixture at constant rate over a period of 17 minutes. Thereafter, 0.47 mg of potassium selenocyanate was added over a period of 30 sec. Then, 26.7 ml of an aqueous silver nitrate solution (containing 7.3 g of silver nitrate) and 26.4 ml of an aqueous halide solution (containing 4.5 g of sodium bromide and 0.07 g of potassium iodide) were simultaneously added to the aforesaid mixture at constant rate over a period of 2 minutes. The silver halide emulsion thus obtained contained 1 mole % of iodide and $2.3\times10^{-6}$ mole of potassium selenocyanate per silver mole. The properties of grains of this emulsion are as follows:

Average Grain ECD: 1.39 μm
Average Grain Thickness: 0.151 μm
Average Aspect Ratio of the Grains: 9.2
Average Tabularity of the Grains: 61
Coefficient of Variation of Total Grains: 8.4%

EXAMPLES 14 and 15

The purpose of these examples is to provide a photographic comparison of an emulsion satisfying the requirements of the invention with a comparable emulsion of the type found in the art.

EXAMPLE 14 (MK202)

Example 9 of Saitou et al U.S. Pat. No. 4,797,354 was repeated, except that 3 percent iodide based on the total moles of silver was added to the emulsion at 70% of the precipitation. At 70% of the precipitation the morphology and COV are well established so that the addition of iodide did not change the COV.

In a 4-liter reaction vessel was placed an aqueous gelatin solution (having pBr of 1.42 and composed of 1 liter of water, 7 g of deionized alkali-processed gelatin, 4.5 g of potassium bromide, and 1.2 ml of 1N potassium hydroxide solution) while keeping the temperature of the solution at 30° C. Twenty-five ml of an aqueous solution of silver nitrate (containing 8.0 g of silver nitrate) and 25 ml of an aqueous solution of potassium bromide (containing 5.8 g of potassium bromide) were simultaneously added to the reaction vessel over a period of 1 minute at a rate of 25 ml/min. Then, an aqueous gelatin solution (composed of 1950 ml of water, 90 g of deionized alkali-processed gelatin, 15.3 ml of 1N aqueous potassium hydroxide solution, and 3.6 g of potassium bromide) was further added to the reaction vessel, and the temperature of the mixture was raised to 75° C. over a period of 10 minutes. Thereafter, ripening was performed for 50 minutes.

The mixture was then transferred to a 12-liter vessel, into which, 200 ml of an aqueous silver nitrate solution (containing 90 g of silver nitrate) were added at a rate of 20 ml/min. Twenty-five seconds after commencing the addition of the silver nitrate the 12-liter vessel, 191.6 ml of an aqueous potassium bromide solution (containing 61.2 g of potassium bromide) were added to the 12-liter vessel at a rate of 20 ml/min., the additions of both solutions being finished at the same time. Thereafter, the resultant mixture was stirred for 2 minutes, then 1336 ml of an aqueous silver nitrate solution (containing 601.9 g of silver nitrate) and 1336 ml of a potassium bromide solution (containing 425.4 g of potassium bromide) were simultaneously added to the aforesaid mixture at a rate of 40 ml/min for the first 20 minutes and 60 ml/min for the subsequent 8.9 minutes.

An iodide solution in the amount of 750 ml containing 29.23 g potassium iodide was added at a rate of 250 ml/min for 3 minutes followed by a 2 minute hold under unvaried conditions. Subsequently 664 ml of an aqueous silver nitrate solution (containing 299.1 g of silver nitrate) and an equal volume of a potassium bromide solution (containing 211.4 g potassium bromide) were simultaneously added at a rate of 40 ml/min for 16.6 minutes. Then, after stirring the mixture for 1 minute, the silver halide emulsion thus obtained was washed and redispersed.

The properties of grains of this emulsion were as follows:

Average Grain ECD: 1.18 μm
Average Grain Thickness: 0.187 μm
Average Aspect Ratio: 6.31
Average Tabularity: 33.7
Coefficient of Variation of Total Grains: 32.6%

When the coefficient of variation of only the hexagonal tabular grains was measured, it was approximately 13%.

EXAMPLE 15 (MK219)

In a 4-liter reaction vessel were placed an aqueous gelatin solution (having a pAg of 9.39 and composed of 1 liter of water, 0.83 g of oxidized alkali-processed gelatin, 4.0 ml of 4N nitric acid solution, and 1.12 g of sodium bromide) and 14.76 wt %, based on total silver introduced up to the beginning of post-ripening grain growth stage, of PLURONIC TM -31R1 (which satisfies formula II with x=25, y=7 and x'=25). While keeping the temperature of the reaction vessel at 45° C., 5.3 ml of an aqueous solution of silver nitrate (containing 0.725 g of silver nitrate) and an equal volume of an aqueous solution of sodium bromide (containing 0.461 g of sodium bromide) were simultaneously added over a period of 1 minute at a constant rate. Then, into the mixture were added 14.2 ml of an aqueous sodium bromide solution (containing 1.46 g of sodium bromide) after 1 minute of mixing. The temperature of the mixture was raised to 60° C. over a period of 9 minutes. At that time, 65 ml of an aqueous ammoniacal solution (containing 3.36 g of ammonium sulfate and 26.7 ml of 2.5N sodium hydroxide solution) were added into the vessel, and mixing was conducted for a period of 9 minutes. Then, 83.3 ml of an aqueous gelatin solution (containing 16.7 g of oxidized alkali-processed gelatin and 11.4 ml of 4N nitric acid solution was added to the mixture over a period of 2 minutes. Thereafter, 83.3 ml of an aqueous silver nitrate solution (containing 22.67 g of silver nitrate) and 81.3 ml of an aqueous sodium bromide solution (containing 14.6 g of sodium bromide) were added at a constant rate for a period of 40 minutes. Then 299 ml of an aqueous silver nitrate solution (containing 81.3 g of silver nitrate) and 285.8 ml of an aqueous sodium bromide solution (containing 51.5 g of sodium bromide) were simultaneously added to the aforesaid mixture at constant ramp starting from respective rate of 2.08 ml/min and 2.12 ml/min for the subsequent 35 minutes. Then, 16.3 ml of an aqueous silver nitrate solution (containing 4.43 g of silver nitrate) and 15.6 ml of an aqueous sodium bromide solution (containing 2.81 g of sodium bromide) were simultaneously added to the aforesaid mixture at constant rate over 1.08 minutes. An iodide solution in the amount of 125 ml containing 4.87 g potassium iodide was added at a rate of 41.7 ml/min for 3 minutes followed by a 2 minute hold under unvaried conditions. Subsequently, 172.2 ml of an aqueous silver nitrate solution (containing 46.8 g of silver nitrate) and an equal volume of an aqueous sodium bromide solution (containing 31.0 g of sodium bromide) were simultaneously added to the aforesaid mixture at constant rate over a period of 20.7 minutes. The silver halide emulsion thus obtained was washed and redispersed.

The properties of grains of this emulsion were as follows:

Average Grain ECD: 1.2 μm
Average Grain Thickness: 0.194 μm
Average Aspect Ratio of the Grains: 6.2
Average Tabularity of the Grains: 31.8
Coefficient of Variation of Total Grains: 4.5%

SENSITIZATION

Each of the emulsions of Examples 14 and 15 were optimally sensitized. Although the ECD, thickness and iodide placement of the tabular grains were essentially similar, the sensitizations that produced optimum photographic response for the emulsions differed, reflecting differences in grain size distributions.

The emulsion of Example 14 exhibited optimum photographic performance with the following sensitization: 0.95 millimole of Dye A (5,5'-dichloro-3,3'-di(3-sulfopropyl)thiacyanine, sodium salt) per mole silver, 3.6 mg of sodium aurous(I)dithiosulfate dihydrate per mole silver, 1.8 mg sodium thiosulfate pentahydrate per mole silver, and 40 mg of 3-(2-methylsulfamoylethyl)-benzothiazolium tetrafluoroborate per mole silver. The emulsion and sensitizers were held at 65° C. for 15 minutes to complete sensitization.

The emulsion of Example 15 exhibited optimum photographic performance with the following sensitization: 0.90 millimole Dye A, 2.7 mg sodium aurous(I) dithiosulfate dihydrate, 1.35 mg sodium thiosulfate pentahydrate and 40 mg 3-(2-methylsulfamoylethyl)-benzothiazolium tetrafluoroborate per mole silver with a 15 minute hold at 65° C. to complete sensitization. Because this emulsion contained fewer fine and nontabular grains, it required smaller amounts of sensitizers for optimum sensitization.

Coating and Processing

The sensitized emulsions were each coated onto a clear cellulose acetate film support. Each emulsion layer contained on a per square decimeter basis 3.77 mg silver, 9.68 mg Coupler X (benzoic acid, 4-chloro-3-{]2-[4-ethoxy-2,5-dioxo-3-(phenyl)methyl-1-imidazolidinyl]-3-(4-methoxyphenyl)-1,3-dioxopropyl-]amino}dodecyl ester), 16.14 mg gelatin and 0.061 mg 1,2,4-triazaindolizine was coated. A gel overcoat of 21.52 mg gelatin per square decimeter and bis(vinylsulfonylmethyl) ether gelatin hardener was coated above the emulsion layer The coated samples were exposed for 1/100 second to a light source of 3000° K. color temperature and through a Wratten TM 2B filter and a step tablet.

The following processing steps and solutions were employed:

| Processing | Time | Temperature |
|---|---|---|
| Developer | 3 min 15 sec | 37.8° C. |

-continued

| Processing | Time | Temperature |
|---|---|---|
| Bleach | 4 min | 37.8° C. |
| Water Wash | 3 min | 35-36.1° C. |
| Fix | 4 min | 37.8° C. |
| Water Wash | 3 min | 35-36.1° C. |
| Stabilizer | 1 min | 37.8° C. |

The processing solutions used for the above processing steps were as follows;

| | |
|---|---|
| Developer | |
| Potassium carbonate, anhydrous | 37.5 g |
| Sodium sulfite, anhydrous | 4.0 g |
| Potassium iodide | 1.2 mg |
| Sodium bromide | 1.3 g |
| 1,3-Diamino-2-propanoltetraacetic acid | 2.5 g |
| Hydroxylamine sulfate | 2.0 g |
| 2-[(4-amino-3-methylphenyl) ethylamino]-sulfate | 4.5 g |
| Water to | 1.0 L |
| Bleach | |
| Ammonium bromide | 50.0 g |
| 1,3-Propanediaminetetraacetic acid | 30.27 g |
| Ammonium hydroxide (28% ammonia) | 35.2 g |
| Ferric nitrate nonahydrate | 36.4 g |
| Glacial acetic acid | 26.5 g |
| 1,3-Diamino-2-propanotetraacetic acid | 1.0 g |
| Ammonium ferric ethylenediamine tetraacetate | 149.0 g |
| Water to make | 1.0 L |
| Fix | |
| Ammonium thiosulfate | 162.0 mL |
| Sodium metabisulfite | 11.85 g |
| Sodium hydroxide (50% solution) | 2.0 mL |
| Water to make | 1.0 L |
| Stabilizer | |
| Formalin | 5.0 mL |
| Water to make | 1.0 L |

Data Analysis

Characteristic curves (plots of density versus exposure) were plotted for each of the coatings prepared with the emulsions of Examples 14 and 15. The coatings produced the same density at the same exposure level at about mid-scale between the toe and shoulder of the characteristic curves, with the Example 14 control emulsion exhibiting a slightly higher toe speed and a lower contrast than the emulsion of Example 15. The granularities of the coatings were measured at the point of intersection of the characteristic curves—that is, at the mid-scale point that produced identical densities at identical exposure levels. The Example 15 emulsion coating exhibited a lower granularity than the Example 14 coating by a margin of 9.8 grain units.

The invention has been described in detail with particular reference to preferred embodiments thereof, but it will be understood that variations and modifications can be effected within the spirit and scope of the invention.

What is claimed is:

1. A photographic emulsion containing a coprecipitated grain population exhibiting a coefficient of variation of less than 10 percent, based on the total grains of said population, said grain population containing at least 50 mole percent bromide, based on silver, and consisting essentially of tabular grains having a mean thickness in the range of from 0.080 to 0.3 μm and a mean tabularity of greater than 8.

2. A photographic emulsion according to claim 1 in which the tabular grains have a mean equivalent circular diameter in the range of from 0.4 to 10 μm.

3. A photographic emulsion according to claim 2 in which the tabular grains have a mean equivalent circular diameter of less than 5 μm.

4. A photographic emulsion according to claim 3 in which the tabular grains have an average aspect ratio of up to 100.

5. A photographic emulsion according to claim 4 in which the tabular grains have an average aspect ratio in the range of from 10 to 60.

6. A photographic emulsion according to claim 1 in which the tabular grains have a mean tabularity greater than 25.

7. A photographic emulsion according to claim 1 in which the tabular grains have a thickness within 0.01 μm of their mean thickness.

8. A photographic emulsion according to claim 1 in which the tabular grains are comprised of at least 80 mole percent bromide, based on total silver.

9. A photographic emulsion according to claim 8 in which a central portion of the tabular grains contains at least 90 mole percent bromide, based on total silver.

10. A photographic emulsion according to claim 1 in which the tabular grains are silver bromide grains.

11. A photographic emulsion according to claim 1 in which the tabular grains are silver bromoiodide grains.

12. A photographic emulsion according to claim 1 in which a polyalkylene oxide block copolymer capable of reducing tabular grain dispersity is present.

13. A photographic emulsion according to claim 12 in which the polyalkylene oxide block copolymer satisfies the formula

LAO1—HAO1—LAO1 where

LAO1 in each occurrence represents a terminal lipophilic alkylene oxide block unit and HAO1 represents a hydrophilic alkylene oxide block linking unit, the HAO1 unit constitutes from 4 to 96 percent of the block copolymer on a weight basis, and the block copolymer has a molecular weight of from 760 to less than 16,000.

14. A photographic emulsion according to claim 13 in which (a) LAO1 in each occurrence contains repeating units satisfying the formula:

$$-(OCH\overset{R^9}{\overset{|}{C}}H_2)-$$

where $R^9$ is a hydrocarbon containing from 1 to 10 carbon atoms, and (b) HAO1 contains repeating units satisfying the formula:

$$-(OCH(R^{10})CH_2)-$$

where $R^{10}$ is hydrogen or a hydrocarbon containing from 1 to 10 carbon atoms substituted with at least one polar substituent.

15. A photographic emulsion according to claim 14 in which the polyalkylene oxide block copolymer satisfies the formula:

$$HO-(CH(CH_3)CH_2O)_x-(CH_2CH_2O)_y-(CH_2CH(CH_3)O)_{x'}-H$$

where x and x' are each in the range of from 6 to 120 and y is in the range of from 2 to 300.

16. A photographic emulsion according to claim 12 in which polyalkylene oxide block copolymer satisfies the formula

HAO2—LAO2—HAO2 where

HAO2 in each occurrence represents a terminal hydrophilic alkylene oxide block unit and LAO2 represents a lipophilic alkylene oxide block linking unit, the LAO2 unit constitutes from 4 to 96 percent of the block copolymer on a weight basis, and the block copolymer has a molecular weight in the range of from 1,000 to of less than 30,000.

17. A photographic emulsion according to claim 16 in which (a) LAO2 contains repeating units satisfying the formula:

$$-(OCH(R^{9})CH_2)-$$

where $R^9$ is a hydrocarbon containing from 1 to 10 carbon atoms, and (b) HAO2 in each occurrence contains repeating units satisfying the formula:

$$-(OCH(R^{10})CH_2)-$$

where $R^{10}$ is hydrogen or a hydrocarbon containing from 1 to 10 carbon atoms substituted with at least one polar substituent.

18. A photographic emulsion according to claim 17 in which the polyalkylene oxide block copolymer satisfies the formula:

$$HO-(CH_2CH_2O)_y-(CH(CH_3)CH_2O)_x-(CH_2CH_2O)_{y'}-H$$

where x is in the range of from 13 to 490 and y and y' are in the range of from 1 to 320.

19. A photographic emulsion according to claim 12 in which the polyalkylene oxide block copolymer satisfies the formula $$(H-HAO3-LAO3)_z-L-(LAO3-HAO3-H)_{z'}$$

where

HAO3 in each occurrence represents a terminal hydrophilic alkylene oxide block unit, LOL represents a lipophilic alkylene oxide block linking unit, z is 2 and z' is 1 or 2, the LOL unit constitutes from 4 to 96 percent of the block copolymer on a weight basis, and the block copolymer has a molecular weight in the range of from greater than 1,100 to of less than 60,000.

20. A photographic emulsion according to claim 19 in which the polyalkylene oxide block copolymer satisfies the formula $$(H-HAO3-LAO3)_z-L-(LAO3-HAO3-H)_{z'}$$

where

HAO3 in each occurrence represents a terminal hydrophilic alkylene oxide block unit, LAO3 in each occurrence represents a lipophilic alkylene oxide block unit, L represents an amine or diamine linking group, z is 2 and z' is 1 or 2.

21. A photographic emulsion according to claim 20 in which the polyalkylene oxide block copolymer satisfies the formula:

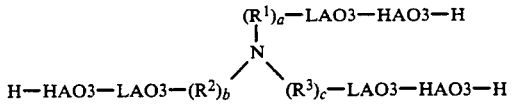

where

HAO3 in each occurrence represents a terminal hydrophilic alkylene oxide block unit, LAO3 in each occurrence represents a lipophilic akylene oxide block unit, $R^1$, $R^2$ and $R^3$ are independently selected hydrocarbon linking groups containing from 1 to 10 carbon atoms; and a, b and c are independently zero or 1.

22. A photographic emulsion according to claim 20 in which the polyalkylene oxide copolymer satisfies the formula:

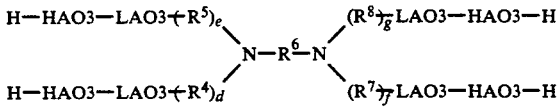

where

HAO3 in each occurrence represents a terminal hydrophilic alkylene oxide block unit, LAO3 in each occurrence represents a lipophilic akylene oxide block unit, $R^4$, $R^5$, $R^6$, $R^7$ and $R^8$ are independently selected hydrocarbon linking groups containing from 1 to 10 carbon atoms; and d, e, f and g are independently zero or 1.

23. A photographic emulsion according to claim 20 in which (a) LAO3 contains repeating units satisfying the formula:

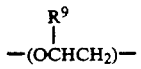

where $R^9$ is a hydrocarbon containing from 1 to 10 carbon atoms, and (b) HAO3 in each occurrence contains repeating units satisfying the formula:

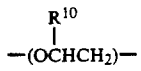

where $R^{10}$ is hydrogen or a hydrocarbon containing from 1 to 10 carbon atoms substituted with at least one polar substituent.

24. A photographic emulsion according to claim 12 in which the polyalkylene oxide block copolymer satisfies the formula $$(H—LAO4)_z—HOL—(LAO4—H)_{z'}$$

where

LAO4 in each occurrence represents a terminal lipophilic alkylene oxide block unit, HOL represents a hydrophilic alkylene oxide block linking unit, z is 2 and z' is 1 or 2, the HOL unit constitutes from 4 to 96 percent of the block copolymer on a weight basis, and the block copolymer has a molecular weight of from greater than 1,100 to less than 50,000.

25. A photographic emulsion according to claim 24 in which the polyalkylene oxide block copolymer satisfies the formula $$(H—LAO4—HAO4)_z—L'—(HAO4—LAO4—H)_{z'}$$

where

LAO4 in each occurrence represents a terminal lipophilic alkylene oxide block unit, HAO4 in each occurrence represents a hydrophilic alkylene oxide block unit, L' represents an amine or diamine linking group, z is 2 and z' is 1 or 2.

26. A photographic emulsion according to claim 25 in which the polyalkylene oxide block copolymer satisfies the formula:

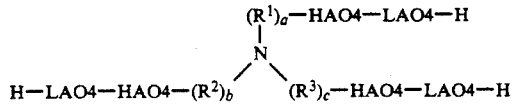

where

LAO4 in each occurrence represents a terminal lipophilic alkylene oxide block unit, HAO4 in each occurrence represents a hydrophilic alkene oxide block unit, $R^1$, $R^2$ and $R^3$ are independently selected hydrocarbon linking groups containing from 1 to 10 carbon atoms; and a, b and c are independently zero or 1.

27. A photographic emulsion according to claim 25 in which the polyalkylene oxide copolymer satisfies the formula:

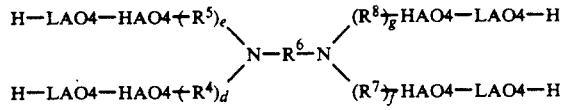

where

LAO4 in each occurrence represents a terminal lipophilic alkylene oxide block unit, HAO4 in each occurrence represents a hydrophilic akylene oxide block unit, $R^4$, $R^5$, $R^6$, $R^7$ and $R^8$ are independently selected hydrocarbon linking groups containing from 1 to 10 carbon atoms; and d, e, f and g are independently zero or 1.

28. A photographic emulsion according to claim 25 in which (a) LAO4 contains repeating units satisfying the formula:

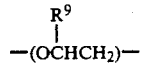

where $R^9$ is a hydrocarbon containing from 1 to 10 carbon atoms, and (b) HAO4 in each occurrence contains repeating units satisfying the formula:

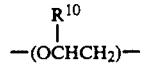

where $R^{10}$ is hydrogen or a hydrocarbon containing from 1 to 10 carbon atoms substituted with at least one polar substituent.

29. A photographic emulsion containing a vehicle and a coprecipitated grain population exhibiting a coefficient of variation of less than 10 percent, based on the total grains of said population, said grain population containing at least 80 mole percent bromide, based on silver, and consisting essentially of tabular grains having a mean thickness in the range of from 0.080 to 0.3 μm and a mean tabularity of greater than 8, the vehicle comprising a gelatino-peptizer containing at least 30 micromoles per gram of methionine and a polyalkylene oxide block copolymer surfactant having a molecular weight in the range of from 760 to 16,000 satisfying the formula:

$$LAO1—HAO1—LAO1$$

where

LAO1 in each occurrence represents a terminal lipophilic alkylene oxide block unit containing at least six —$OCH(CH_3)CH_2$— repeating units and HAO1 represents a hydrophilic alkylene oxide block linking unit containing —$OCH_2CH_2$— repeating units forming 5 to 85 percent of the total surfactant molecular weight.

30. A photographic emulsion containing a vehicle and a coprecipitated grain population exhibiting a coefficient of variation of less than 10 percent, based on the total grains of said population, said grain population containing at least 90 mole percent bromide, based on silver, and consisting essentially of tabular grains having a mean thickness in the range of from 0.080 to 0.3 μm and a mean tabularity of greater than 8, the vehicle comprising a gelatino-peptizer containing at least 30 micromoles per gram of methionine and a polyalkylene oxide block copolymer surfactant having a molecular weight in the range of from 1000 to 10,000 satisfying the formula:

LAO1—HAO1—LAO1 where

LAO1 in each occurrence represents a terminal lipophilic alkylene oxide block unit containing at least seven —$OCH(CH_3)CH_2$— repeating units and HAO1 represents a hydrophilic alkylene oxide block linking unit containing —$OCH_2CH_2$— repeating units forming 10 to 80 percent of the total surfactant molecular weight.

31. A photographic emulsion containing a vehicle and a coprecipitated grain population exhibiting a coefficient of variation of less than 10 percent, based on the total grains of said population, said grain population containing at least 80 mole percent bromide, based on silver, and consisting essentially of tabular grains having a mean thickness in the range of from 0.080 to 0.3 μm and a mean tabularity of greater than 8, the vehicle comprising a gelatino-peptizer containing less than 30 micromoles per gram of methionine and a polyalkylene oxide block copolymer surfactant having a molecular weight in the range of from 760 to 16,000 satisfying the formula:

LAO1—HAO1—LAO1 where

LAO1 in each occurrence represents a terminal lipophilic alkylene oxide block unit containing at least six —$OCH(CH_3)CH_2$— repeating units and HAO1 represents a hydrophilic alkylene oxide block linking unit containing —$OCH_2CH_2$—repeating units forming 4 to 35 percent of the total surfactant molecular weight.

32. A photographic emulsion containing a vehicle and a coprecipitated grain population exhibiting a coefficient of variation of less than 10 percent, based on the total grains of said population, said grain population containing at least 90 mole percent bromide, based on silver, and consisting essentially of tabular grains having a mean thickness in the range of from 0.080 to 0.3 μm and a mean tabularity of greater than 8, the vehicle comprising a gelatino-peptizer containing less than 30 micromoles per gram of methionine and a polyalkylene oxide block copolymer surfactant having a molecular weight in the range of from 1000 to 10,000 satisfying the formula:

LAO1—HAO1—LAO1 where

LAO1 in each occurrence represents a terminal lipophilic alkylene oxide block unit containing at least seven —$OCH(CH_3)CH_2$— repeating units and HAO1 represents a hydrophilic alkylene oxide block linking unit containing —$OCH_2CH_2$— repeating units forming 10 to 30 percent of the total surfactant molecular weight.

33. A photographic emulsion containing a vehicle and a coprecipitated grain population exhibiting a coefficient of variation of less than 10 percent, based on the total grains of said population, said grain population containing at least 80 mole percent bromide, based on silver, and consisting essentially of tabular grains having a mean thickness in the range of from 0.080 to 0.3 μm and a mean tabularity of greater than 8, the vehicle comprising a gelatino-peptizer containing at least 30 micromoles per gram of methionine and a polyalkylene oxide block copolymer surfactant having a molecular weight in the range of from 800 to 30,000 satisfying the formula:

HAO2—LAO2—HAO2 where

HAO2 in each occurrence represents a terminal hydrophilic alkylene oxide block unit containing —$OCH_2CH_2$— repeating units and LAO2 represents a lipophilic alkylene oxide block linking unit containing at least thirteen —$OCH(CH_3)CH_2$— repeating units and accounting for from 15 to 95 percent of the total surfactant molecular weight.

34. A photographic emulsion containing a vehicle and a coprecipitated grain population exhibiting a coefficient of variation of less than 10 percent, based on the total grains of said population, said grain population containing at least 90 mole percent bromide, based on silver, and consisting essentially of tabular grains having a mean thickness in the range of from 0.080 to 0.3 μm and a mean tabularity of greater than 8, the vehicle comprising a gelatino-peptizer containing at least 30 micromoles per gram of methionine and a polyalkylene oxide block copolymer surfactant having a molecular weight in the range of from 1000 to 20,000 satisfying the formula:

HAO2—LAO2—HAO2 where

HAO2 in each occurrence represents a terminal hydrophilic alkylene oxide block unit containing —$OCH_2CH_2$— repeating units and LAO2 represents a lipophilic alkylene oxide block linking unit containing at least thirteen —$OCH(CH_3)CH_2$— repeating units and accounting for from 20 to 90 percent of the total surfactant molecular weight.

35. A photographic emulsion containing a vehicle and a coprecipitated grain population exhibiting a coefficient of variation of less than 10 percent, based on the total grains of said population, said grain population containing at least 80 mole percent bromide, based on silver, and consisting essentially of tabular grains having a mean thickness in the range of from 0.080 to 0.3 μm and a mean tabularity of greater than 8, the vehicle comprising a gelatino-peptizer containing less than 30 micromoles per gram of methionine and a polyalkylene oxide block copolymer surfactant having a molecular weight in the range of from 800 to 30,000 satisfying the formula:

HAO2—LAO2—HAO2 where

HAO2 in each occurrence represents a terminal hydrophilic alkylene oxide block unit containing —$OCH_2CH_2$— repeating units and LAO2 represents a lipophilic alkylene oxide block linking unit containing at least thirteen —$OCH(CH_3)CH_2$— repeating units and accounting for from 40 to 96 percent of the total surfactant molecular weight.

36. A photographic emulsion containing a vehicle and a coprecipitated grain population exhibiting a coefficient of variation of less than 10 percent, based on the total grains of said population, said grain population containing at least 90 mole percent bromide, based on silver, and consisting essentially of tabular grains having a mean thickness in the range of from 0.080 to 0.3 μm and a mean tabularity of greater than 8, the vehicle comprising a gelatino-peptizer containing less than 30 micromoles per gram of methionine and a polyalkylene oxide block copolymer surfactant having a molecular weight in the range of from 1000 to 20,000 satisfying the formula:

HAO2—LAO2—HAO2 where

HAO2 in each occurrence represents a terminal hydrophilic alkylene oxide block unit containing —$OCH_2CH_2$— repeating units and LAO2 represents a lipophilic alkylene oxide block linking unit containing at least thirteen —$OCH(CH_3)CH_2$— repeating units and accounting for from 60 to 90 percent of the total surfactant molecular weight.

37. A photographic emulsion containing a vehicle and a coprecipitated grain population exhibiting a coefficient of variation of less than 10 percent, based on the total grains of said population, said grain population containing at least 80 mole percent bromide, based on silver, and consisting essentially of tabular grains having a mean thickness in the range of from 0.080 to 0.3 μm and a mean tabularity of greater than 8, the vehicle comprising a gelatino-peptizer containing at least 30 micromoles per gram of methionine and a polyalkylene oxide block copolymer surfactant having a molecular weight in the range of from 1,100 to 60,000 satisfying the formula:

$(H—HAO3—LAO3)_2—L—(LAO3—HAO3—H)_2$ where

L represents an ethylene diamine linking unit,

LAO3 in each occurrence represents a lipophilic alkylene oxide block unit containing at least three —$OCH(CH_3)CH_2$— repeating units, HAO3 in each occurrence represents a hydrophilic alkylene oxide block unit containing —$OCH_2CH_2$— repeating units, and L and LAO3 in all occurrences together account for 15 to 95 percent of the total surfactant molecular weight.

38. A photographic emulsion according to claim 37 in which the tabular grains contain at least 90 percent bromide, the polyalkylene oxide block copolymer surfactant has a molecular weight in the range of from 2,000 to 40,000, and L and each LAO3 together account for 20 to 90 percent of the total surfactant molecular weight.

39. A photographic emulsion containing a vehicle and a coprecipitated grain population exhibiting a coefficient of variation of less than 10 percent, based on the total grains of said population, said grain population containing at least 80 mole percent bromide, based on silver, and consisting essentially of tabular grains having a mean thickness in the range of from 0.080 to 0.3 μm and a mean tabularity of greater than 8, the vehicle comprising a gelatino-peptizer containing at least 30 micromoles per gram of methionine and a polyalkylene oxide block copolymer surfactant having a molecular weight in the range of from 1,100 to 50,000 satisfying the formula:

$(H—LAO4—HAO4)_2—L'—(HAO4—LAO4—H)_2$ where

L' represents an ethylene diamine linking unit,

LAO4 in each occurrence represents a lipophilic alkylene oxide block unit containing at least three —$OCH(CH_3)CH_2$— repeating units, HAO4 in each occurrence represents a hydrophilic alkylene oxide block unit containing —$OCH_2CH_2$— repeating units, and L' and LAO4 in all occurrences together account for 5 to 85 percent of the total surfactant molecular weight.

40. A photographic emulsion according to claim 39 in which the tabular grains contain at least 90 percent bromide, the polyalkylene oxide block copolymer surfactant has a molecular weight in the range of from 2,000 to 30,000, and L' and each LAO4 together account for 10 to 80 percent of the total surfactant molecular weight.

41. A photographic emulsion according to any one of claims 29 to 40 inclusive in which the emulsion is a silver bromide emulsion.

42. A photographic emulsion according to any one of claims 29 to 40 inclusive in which the emulsion is a silver bromoiodide emulsion.

43. A photographic emulsion according to any one of claims 29 to 40 inclusive in which the halide ion forming the central portion of the tabular grains consists essentially of bromide ion and up to 6 mole percent iodide ion, based on silver.

* * * * *